US005513942A

United States Patent [19]

Pickrell

[11] Patent Number: 5,513,942

[45] Date of Patent: May 7, 1996

[54] REFUSE HOLDING VEHICLE

[75] Inventor: John W. Pickrell, Scottsdale, Ariz.

[73] Assignee: The Heil Company, Chattanooga, Tenn.

[21] Appl. No.: 373,524

[22] Filed: Jan. 17, 1995

Related U.S. Application Data

[63] Continuation of Ser. No. 230,415, Apr. 19, 1994, abandoned, which is a continuation of Ser. No. 646,697, Jan. 28, 1991, abandoned, which is a continuation of Ser. No. 5,360, Jan. 12, 1987, abandoned, which is a continuation of Ser. No. 817,795, Jan. 9, 1986, abandoned, which is a continuation of Ser. No. 657,734, Oct. 4, 1984, abandoned, which is a division of Ser. No. 412,012, Aug. 26, 1982, abandoned.

[51] Int. Cl.[6] ..... B65F 3/02

[52] U.S. Cl. ..... 414/525.2; 100/100; 100/233; 414/408

[58] Field of Search ..... 414/406, 408, 414/293, 303, 404, 422, 525.1–525.55; 100/100, 233, 270, 271, 278

[56] References Cited

U.S. PATENT DOCUMENTS

| | | | |
|---|---|---|---|
| 2,252,608 | 8/1941 | Ballert | 414/525.55 X |
| 3,220,577 | 11/1965 | Laverne | 100/233 X |
| 3,539,061 | 11/1970 | Burgess | 414/525.5 |
| 3,687,313 | 8/1972 | Smith | 414/525.55 |
| 3,786,949 | 1/1974 | Sutton | 414/406 |
| 3,822,802 | 7/1974 | Evans, Jr. | 414/373 X |
| 3,841,508 | 10/1974 | Ebeling et al. | 414/406 |
| 3,946,885 | 3/1976 | Menkel, Jr. et al. | 414/408 |
| 4,173,423 | 11/1979 | Pickrell | 414/404 |
| 4,175,903 | 11/1979 | Carson | 414/422 X |
| 4,313,707 | 2/1982 | Bingman et al. | 414/467 X |
| 4,383,790 | 5/1983 | Smith | 414/525.54 X |

FOREIGN PATENT DOCUMENTS

| | | | |
|---|---|---|---|
| 1196122 | 5/1959 | France | 414/525.55 |
| 2519931 | 10/1976 | Germany | 100/233 |
| 9827 | 1/1979 | Japan | 414/406 |
| 506549 | 5/1976 | U.S.S.R. | 414/525.5 |

OTHER PUBLICATIONS

Hydraulics and Pneumatics, Sep. 1976, pp. 118–119, 122, E. C. Copeland, "10–Solenoid–Valve Control Stick Gives Truck Operator 'Extra Hands'".

*Primary Examiner*—David A. Bucci

*Attorney, Agent, or Firm*—Parsons & Associates; Don J. Flickinger; Robert A. Parsons

[57] ABSTRACT

A refuse collection and storage body is carried by the frame of a truck chassis having a cab at the forward end thereof. A hopper having a rotatably reciprocal platen therein resides at the forward end of the body. Refuse within the body is discharged through an openable tailgate assembly at the rear of the body. A fixed length arm is pivotly connected at one end thereof to a carriage which is reciprocally movable along a transverse support beam. The arm, having refuse container gripping arms at the free end thereof, is rotatably elevatable for dumping the contents of the container into the hopper. The several movable components are responsive to a control apparatus located within the cab.

7 Claims, 9 Drawing Sheets

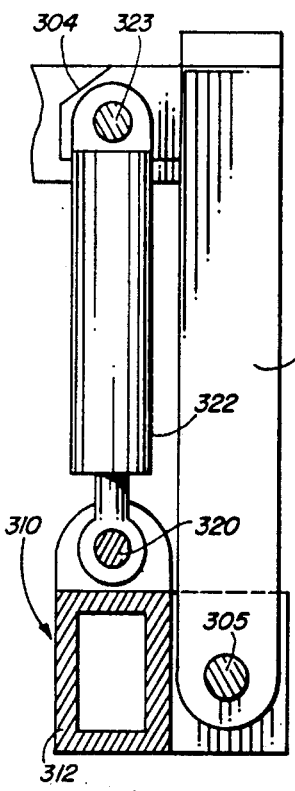
FIG. 9
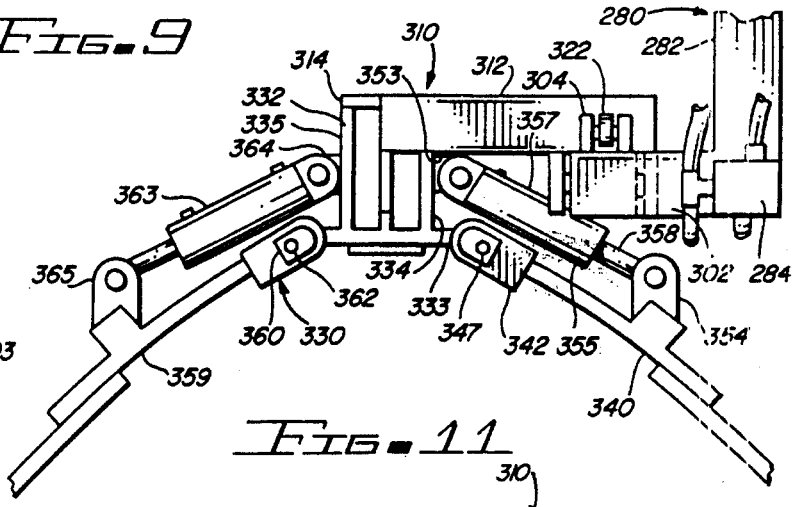
FIG. 11
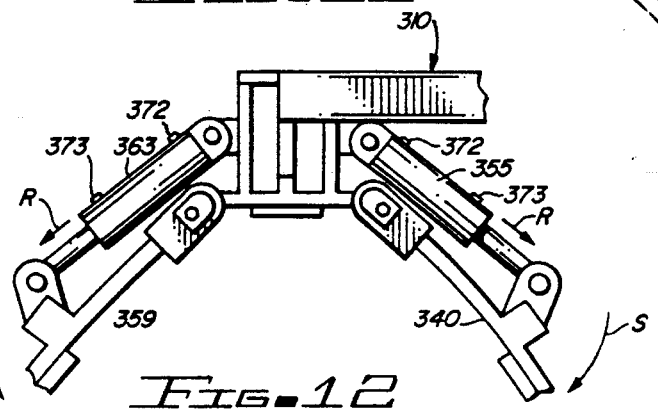
FIG. 12
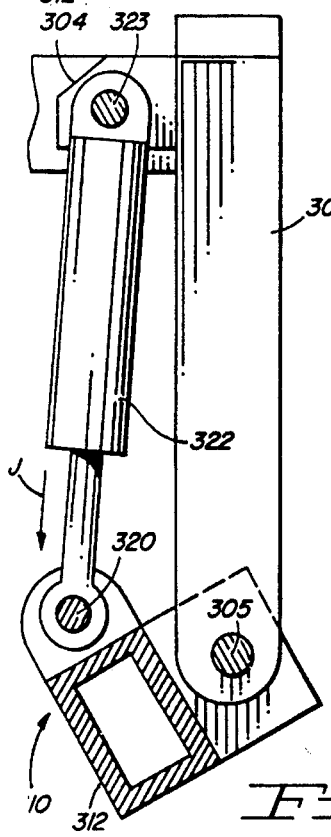
FIG. 10
FIG. 13
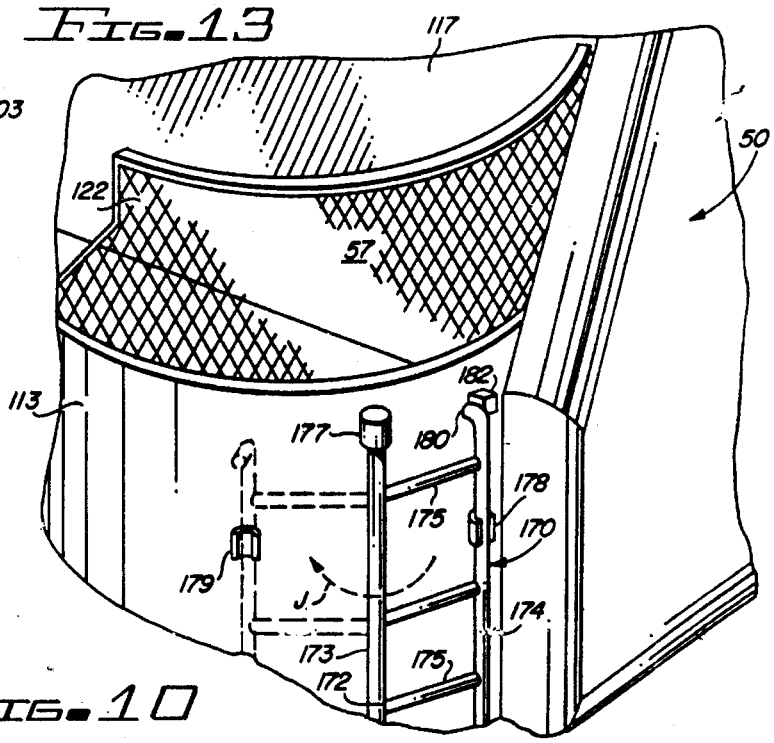

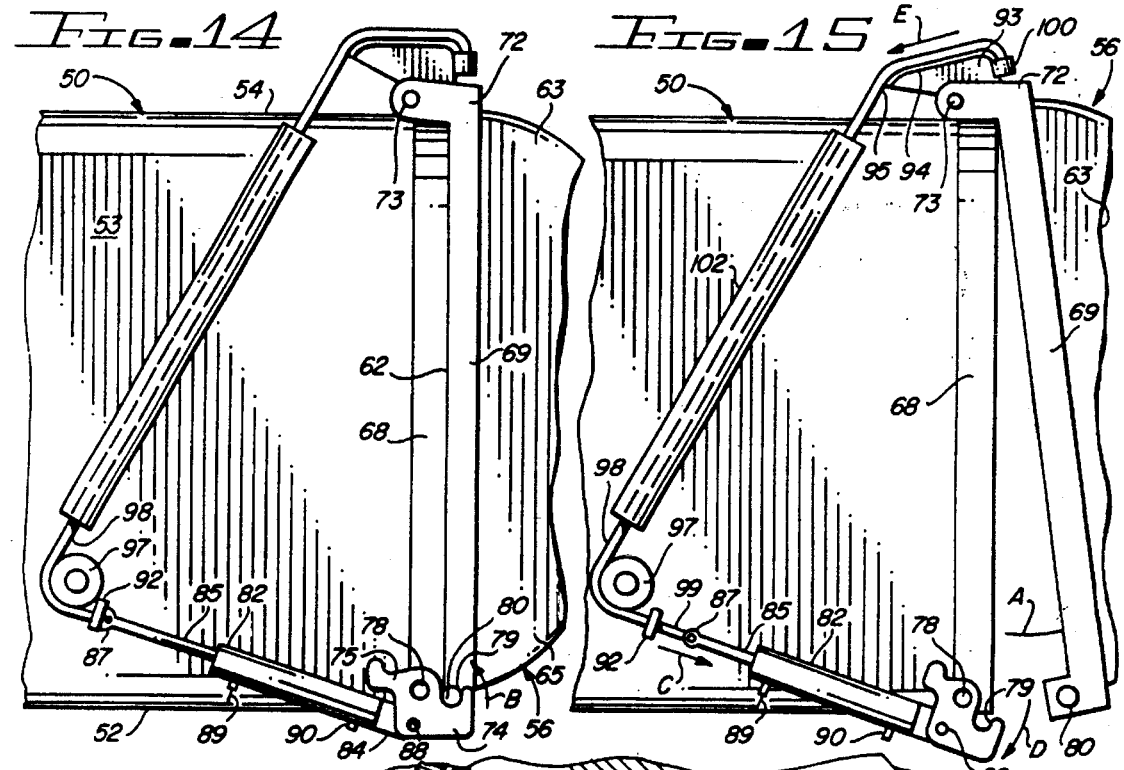
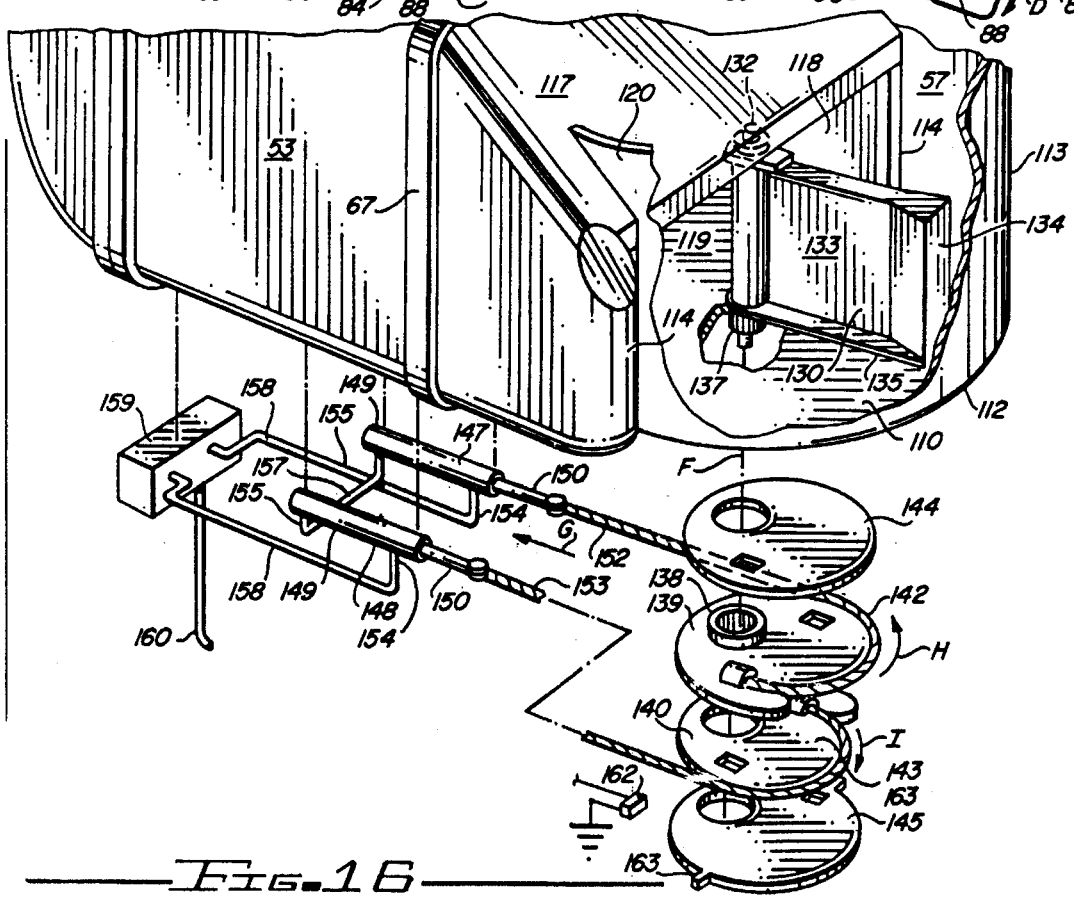
FIG. 16

REFUSE HOLDING VEHICLE

The present application is a continuation of application Ser. No. 08/230,415, filed Apr. 19, 1995, now abandoned, which is a continuation of application Ser. No. 07/646,697, filed Jan. 28, 1991, now abandoned, which is a continuation of application Ser. No. 07/005,360, filed Jan. 12, 1987, now abandoned, which is a continuation of application Ser. No. 06/817,795, filed Jan. 9, 1986, now abandoned which is a continuation of application Ser. No. 06/657,734, filed Oct. 4, 1984, now abandoned which is a division of application Ser. No. 06/412,012, filed Aug. 26, 1982, now abandoned.

FIELD OF THE INVENTION

This invention relates to refuse handling equipment.

In a further aspect, the present invention relates to refuse collection vehicles of the type having a compactor body and a mechanical side-loading device.

More particularly, the instant invention concerns novel features for the improved control and operation of refuse collection vehicles.

PRIOR ART

The collection and removal of refuse, the solid wastes of a community, is a major municipal problem. For example, residential refuse is generated at an average rate of approximately two pounds per day per capita. As accumulated, loose and uncompacted, the refuse has density generally in the range of 150–300 pounds per cubic yard. For the health and welfare of the community, regular disposal is imperative.

Traditionally, residential refuse, including garbage, trash, and other waste materials, was amassed and stored in containers of approximately ten to thirty gallon capacity. On a regular basis, usually once or twice weekly, the containers were placed by the householder at a designated location for handling by the scheduled collection agency. Frequently designated locations were curbside and alley line. Not uncommonly, the refuse of a single residence, depending upon the number of occupants and the frequency of service, would occupy two or more containers, each weighing as much as seventy-five to one hundred pounds.

The conventional refuse collection method involved a mechanized unit supplemented with manual labor. The mechanized unit, or collection vehicle, included a refuse handling body mounted upon a truck chassis. Generally, the vehicle was attended by a crew of three or more. One of the crew, the driver, attended to operation of the vehicle while the others, known as collectors, brought the householder's refuse to the vehicle.

Commonly, the vehicle included a hopper of conveniently low loading height into which the collectors emptied the containers. Means were provided for transferring the refuse from the hopper to the body. The body, which may have been equipped with a compactor, also included unloading means for ejecting the refuse at the disposal site.

Recently, considerable interest among practitioners of the art has been directed to the development of equipment for the enhancement of the traditional refuse collection method. Resultantly, current methodology directs that refuse is placed in relatively large containers of uniform dimensions which are handled by automated equipment. The containers may, for example, be of sufficient size to service several households. The collection vehicle is equipped with a self-loading device which lifts and dumps the container. Increased load carrying capacity of the vehicle is achieved through the use of compactor-type bodies.

Innovators and researchers in the art have not, however, reached any semblance of accord on the specifics of mechanizing the collection of refuse. Accordingly, the art has rapidly swelled with numerous proposals which purportedly offer the optimum solution.

For example, while there is general agreement upon the desirability of the compactor-type body, the art vacillates among various reciprocating platen and auger-type packer mechanisms. Loading is alternately accomplished by front, side or rear mounted mechanisms which may incorporate either fixed or extendable length arms. Numerous other disagreements and divergencies permeate the art.

The multitudinous prior art proposals, however, have not provided an entirely satisfactory solution to the automated collection of refuse. Since the reciprocating packer is operational in only one direction, fully one-half of the movement thereof, the return stroke, is wasted motion and lost time. Further, dumping of the container must be coordinated to prevent the accumulation of material on the backside of the platen. While the auger provides continuous operation, it is at the expense of increased manufacturing costs and decreased reliability. Subjected to unequal forces and having bearings at only one end, the device can be wedged to a stop. It is seen, therefore, that each is subject to periodic malfunction requiring attendance by the operator and temporarily halting the collection of refuse.

Commonly, the lifting arm of the loading mechanism pivots about a fixed axis. In the lowered position, the free end of the arm is engageable with the refuse container. In the elevated position, the arm positions the container for dumping, the act of emptying the container into the refuse receiving portion of the body. The fixed length arm generally requires tedious, precise maneuvering of the collection-vehicle. Therefore, especially for residential collection, the art has pursued the extensible, or telescoping arm type loader.

Refuse containers are frequently positioned against an upright object, such as a wall or fence, or partially reside under an obstruction, such as the overhang of a building or shed. The telescoping arm is transported in the retracted position; being partially extended, after the vehicle has come to a stop, to the required length to engage the container. Extending the arm to grasp the container at the predetermined elevational location, requires certain care and attention. Unless the arm is in the absolute horizontal position, the height of the grip, at the end thereof, is altered in response to extension or retraction. Thereafter, the arm must be partially retracted, prior to extension to dumping length, to avoid outswing and smashing the container into the nearby objects. The other problem is magnified in response to the height of the pivot of the arm.

Telescoping arms tend to be extendingly heavy, having undesirable characteristics of inertia, due to the incorporation of the telescoping mechanism into the pivotably mounted portion of the structure. Further, the telescoping arm defines a lever arm of variable length. Accordingly, the lifting capacity is reduced in direct proportion to the extended length.

Various other inadequacies of the prior art are observable. Frequently, the operator, in order to observe the relationship between the loading arm and the refuse container, is forced to operate the vehicle from the right-hand position, an unnatural and unsafe practice. Even so, the driver is frequently at a loss to observe both the resting place of the container and the dumping position. Speed of operation is hampered by linear sequential control mechanism. The hydraulic devices, typically used to hold a tailgate in the closed position, are subject to leaking or gradual loss of fluid with obvious undesirable results. Frequently, the collection activity is temporarily terminated for the purpose of clearing a jam of the packer or cleaning material from behind the platen. Often, the driver is required to exit the cab of the vehicle at the disposal site to assist in the unloading of the body or to clean the frame before the lowering of a tilt-type body, an exceedingly hazardous practice due to the presence and proximity of numerous other vehicles.

It would be highly advantageous therefore to remedy the foregoing and other deficiencies inherent in the art.

Accordingly, it is an object of the present invention to provide improvements in refuse collection equipment.

Another object of the invention is the provision of a vehicle having an improved refuse collection and handling system.

And another object of the invention is to provide a refuse collection vehicle which is effectively operated and controlled from the conventional left-hand driver position.

Still another object of this invention is the provision of improved continuously operable packer means.

Yet another object of the invention is to provide a side-loader mechanism having extended reach and improved lifting characteristics.

Yet still another object of the instant invention is the provision of an easily operable, multiple actuation control system.

And a further object of the immediate invention is to provide an integrated refuse collection system having significantly decreased loading cycle time.

Yet a further object of the invention is the provision of a refuse collection vehicle which is entirely operable from within the driver compartment.

Still another object of the invention is to provide for a more compact vehicle of comparable load carrying capacity.

And yet another object of the invention is the provision of a refuse collection vehicle of the above type which is safer, easier and more economical to operate than conventional prior art equipment.

SUMMARY

Briefly, to achieve the desired objects of the instant invention in accordance with a preferred embodiment thereof, first provided is a refuse storage and collection body mounted upon the frame of a truck chassis. In general similarity to a conventional truck chassis, the frame is supported above ground level by front wheels and rear wheels. The front wheels, being steerable, provide directional control for the vehicle. The rear wheels are caused to rotate in response to conventional engine, transmission and drive train. Controls for manipulation of the chassis are located within a cab carried by the frame forward of the refuse storage and collection body.

The body terminates at the forward end with an open top hopper bounded by a semi-circular front wall. The height of the wall is extended by a screen structure. A packer assembly including a platen mounted at one end thereof for rotation within the hopper moves refuse from the hopper through an opening into the refuse collection body. Hydraulic means coupled to the platen imparts reciprocal rotary motion to the platen. In accordance with an embodiment of the invention, the line of force from the face of the platen when at the terminus of the packing cycle, projects through the physical center of the body.

Next provided is a loader assembly for emptying the contents of a refuse container into the hopper. In accordance with a preferred embodiment of the invention, the loader assembly includes a carriage reciprocally movable upon a support beam extending transfers of the frame. A lifting arm of fixed length is pivotly coupled at one end thereof to the carriage for vertical movement through a predetermined arc. A grasping assembly is carried at the second end of the arm for gripping the refuse container.

A tailgate assembly is carried at the rear of the refuse storage body. The assembly includes a closure member pivotly mounted to an upper portion of the body and normally held in the closed position by a latch member engagable with a locking pin carried by that body. A sheave segment is fixedly coupled to the closure member for rotation about the pivotable mount. Hydraulic means are coupled to the latch member and to the sheave segment for causing the latch member to selectively engage and disengage the locking pin and for exerting force upon the sheave segment to respectively close and open the enclosure member. The sheave segment is eccentric such that the speed of the closure member will be the lowest at the closed position and the force exerted on the closure member will be the greatest near the closed position. The body is pivotally secured to the frame and elevated by hydraulic means for ejection of the collected refuse in response to opening of the closure member.

A ladder assembly is pivotally coupled to the external side of the wall of the hopper. The ladder is movable between a use position and a non-use position. The ladder assembly further includes switch means for disabling the platen when the ladder is moved into the use position.

Further provided is a control apparatus, preferably located within the operator's compartment, for simultaneously controlling a plurality of distinct functions. The control apparatus includes a shaft having a second section journaled for rotation and translation within a second section. A handle is fixedly coupled to the free end of the second section. In response to directed movement of the handle, selected switches are contacted by discrete camming means carried by the shaft sections. Selected ones of a plurality of series oriented valves are actuated in response to the several switches for operatively controlling the loader assembly. Additional switches are carried by the control apparatus for operatively controlling the packer assembly, the tailgate assembly and other operative elements of the refuse collection vehicle.

BRIEF DESCRIPTION OF THE DRAWINGS

The foregoing and further and more specific objects and advantages of the instant invention will become readily apparent to those skilled in the art from the following detailed description of preferred embodiments thereof, taken in conjunction with the drawings, in which:

FIG. 9 is an enlarged, fragmentary, vertical, elevation view, partially in section, of the container dumping actuating mechanism seen in FIG. 8 as it would appear during the rest cycle;

FIG. 10 is an illustration generally corresponding to the view of FIG. 9 and illustrating the displacement of the components during the dumping cycle;

FIG. 11 is a plan view on a reduced scale of the container gripping mechanism carried at the free end of the loader assembly as seen in FIG. 4;

FIG. 12 is a view generally corresponding to the illustration of FIG. 11 and taken at a time subsequent theseto during the grasping cycle;

FIG. 13 is an enlarged fragmentary perspective view of a forward portion of the refuse containing body of FIG. 1 including a portion of the hopper associated therewith and especially illustrating the access ladder;

FIG. 14 is an enlarged, fragmentary, side elevation view of a rearward portion of the vehicle of FIG. 1, especially showing the tailgate in the closed and locked position;

FIG. 15 is an illustration generally corresponding to the view of FIG. 14 and showing the tailgate in the unlocked and partially opened position;

FIG. 16 is a fragmentary, partially exploded, perspective view of the refuse containing body illustrated in FIG. 1 and especially showing the packer mechanism;

DETAILED DESCRIPTION OF THE PREFERRED EMBODIMENTS

Figure 1:
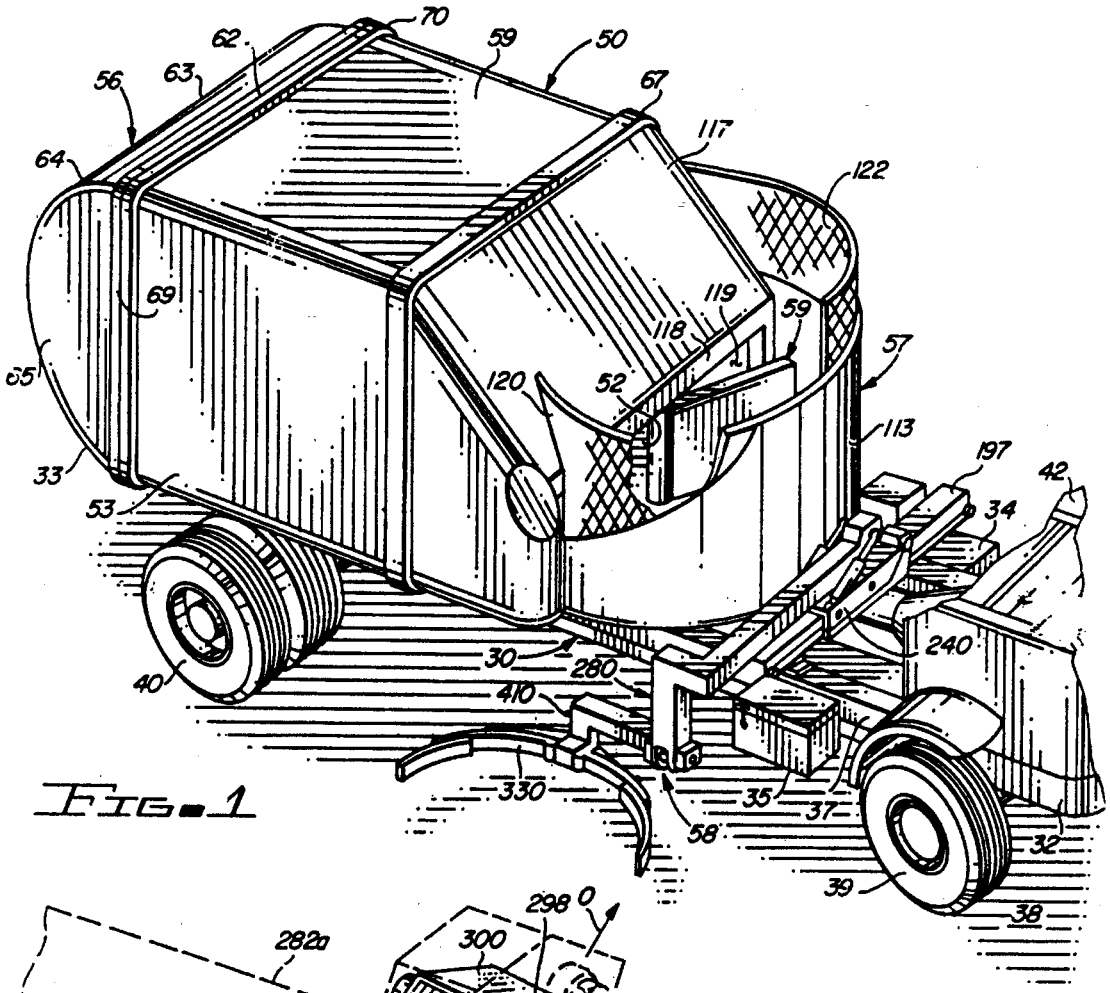
FIG. 1 is a perspective view of a motor vehicle embodying the refuse collection system of the instant invention, portions of the vehicle being broken away for purposes of illustration.

Turning now to the drawings in which like reference characters indicate corresponding elements throughout the several views, attention is first directed to FIG. 1 which illustrates a refuse collection vehicle embodying the improvements of the instant invention including a chassis, generally designated by the reference character 30, which, for purposes of orientation throughout the ensuing discussion, is considered to have a forward end 32, a rearward end 33, a left or street side 34, and a right or curb side 35. In general similarity to a conventional truck chassis, chassis 30 includes frame 37 supported above ground level 38 by front wheels 39 and rear wheels 40. In accordance with conventional practice, front wheels 39, being steerable, provide directional control for the vehicle. Similarly, rear wheels 40, caused to rotate in response to a conventional engine, transmission and drive train, not specifically illustrated, for propulsion of the unit. Cab 42, carried at the forward end 32 of frame 37, provides for an enclosed driver's compartment including the conventional controls associated with manipulation of the chassis.

A compactor-type refuse collection body, generally designated by the reference character 50, is carried upon chassis 30 at a generally rearward location for greater support by the wheels 40. Body 50, being a hollow refuse receiving and storage receptacle, is generally defined by bottom, or lower horizontal panel, 52, a pair of spaced apart upright side panels 53 (only one herein specifically illustrated) and a top, or upper horizontal panel, 54. At the rearward end, the receptacle is normally closed by tailgate assembly 56.

Hopper 57 is integral with the forward portion of body 50. A loader assembly, generally designated by the reference character 58 and residing intermediate cab 42 and hopper 57, serves to manipulate refuse containers and empty the contents thereof into hopper 57. A packer mechanism, generally designated as 59, moves the material into the receptacle portion of body 50.

The foregoing cursory description of a refuse collection vehicle constructed in accordance with the teachings of the instant invention is set forth for purposes of orientation. Various elements thereof, being typical and well known by those skilled in the art, will not warrant further description. Various novel features, representing improvements in the art, will be set forth below in clear and concise detail.

TAIL GATE ASSEMBLY

The respective rearward edges of lower horizontal panel 52, upright side panels 53, and upper horizontal panel 54 mutually terminate along the plane defined by line 62 which defines the rear open end of body 50, especially the receptacle portion thereof. As further viewed in FIG. 1, tailgate assembly 56 includes tailgate, or closure member, 63. In accordance with the immediately preferred embodiment of the invention, closure member 63 is generally in the form of a longitudinal section of a hollow right cylinder formed by arcuate rear panel 64 and a pair of substantially planar side panels 65. The forwardly directed edges of the panels 64 and 65 also mutually terminate along the plane defined by line 62. In other words, the plane 62 represents the parting line between the receptacle portion and the tailgate portion of body 50.

In accordance with conventional practice, the several panels of the body and tailgate are fabricated of metallic plate stock of sufficient thickness and strength to withstand the pressures generated during compaction of the load. For additional strength, in accordance with the immediately preferred embodiment of the instant invention, body 50 is encircled by forward and rearward reinforcing members 67 and 68, respectively. A similar reinforcing member 69 encircles tailgate 63. Reinforcing members 68 and 69 abut along line 62. Depending upon the length of the body, materials of construction and other engineering criteria, body 50 may incorporate additional reinforcing members.

A pair of spaced apart mounting brackets 70 are secured to reinforcing member 68. One bracket 70 resides proximate the juncture of upper horizontal panel 54 and the respective upright side panel 53. A pair of tabs 72, as more clearly seen in FIG. 14, extend upwardly forward from reinforcing member 69. One tab 72 resides immediately outboard of each mounting bracket 70. A pin 73 connects each tab 72 with the mating mounting bracket 70. While pin 73 may assume various specific configurations, a shoulder bolt, rotatably journaled within tab 72 and threadedly engaged within mounting bracket 70, is suggested. Hence, tailgate 63 is pivotably connected to the receptacle portion of body 50 and movable between a closed position, as illustrated in FIG. 14, and an open position in the direction of arrowed line A as suggested in FIG. 15.

Tailgate assembly 56 further includes a latching mechanism for controlling tailgate, or closure member, 63. A latch member 74 is pivotally connected to rearward reinforcing member 68 by virtue of pin 78. Latch member 74 further includes generally U or hook-shape camming surface 79 which is engagable with locking pin 80 projecting from tailgate reinforcing member 69. The interaction between camming surface 79 and locking pin 80 will become apparent presently.

Latch member 74 is caused to rotate about pivot pin 78 by hydraulic cylinder assembly 82 which includes cylinder 83 having free end 84 and reciprocally movable operating rod 85 having free end 87. Free end 84 of cylinder 83 is pivotably secured to latch member 74 by pin 88. Being a conventional double acting assembly, cylinder 83 includes first and second fluid ports 89 and 90, respectively, each of which alternately function as intake and exhaust for selective reciprocal movement of operating rod 85. Abutment 92 projects outwardly from body 50 and receives the free end 87 of operating rod 85 thereagainst in the extended position.

A sheave segment 93, having the typical peripheral groove 94, is secured to tailgate 63. It is especially noted that sheave segment 93 is eccentric with respect to pin 73. The eccentricity is such that the forwardly directed initial end 95 of peripheral groove 94 is the farthest portion of groove 94 from pin 73. A pulley 97 is rotatably secured to upright side 53 of body 50.

Cable 98, extending around pulley 97 and through an appropriately sized opening within abutment 92, connects cylinder assembly 82 with sheave segment 93. First end 99 of cable 98 is secured to the free end 87 of operating rod 85. Second end 100 of cable 98 is secured to sheave segment 93 at a point remote from initial end 95. The terminal section of cable 98, adjacent end 100, normally resides within groove 94. The intermediate portion of cable 98, extending along side 53, passes through and is protected by shield 102.

FIG. 14 illustrates tailgate 63 as it would appear in the closed position. In response to the input of pressurized hydraulic fluid through port 90, operating rod 85 is extended to bear against abutment 92. Concurrently, latch member 74 is caused to rotate about pivot pin 78 in the direction of arrowed line B. Resultingly, camming surface 79 urges locking pin 80 forwardly, tightly closing tailgate 63. Latch member 74 is configured such that, in the closed position, a first line drawn through the axes of rotation of pin 78 and 88 will be substantially perpendicular to a second line passing through the axes of rotation of pins 78 and 80. The axis of pin 78 resides at the apex of the described right angle.

Alternately, the input of pressurized fluid through port 89 retracts operating rod 85 as indicated by the arrowed line C causing counter-rotation of latch member 74 in the direction of arrowed line D for release of pin 80 and unlatching of tailgate 63. Concurrently, cable 98 is moved in the direction of arrowed line E causing tailgate 63 to pivot about pin 73 in the direction of arrowed line A as seen in FIG. 15.

The opening and closing of tailgate 63 is progressive. For purposes of illustration, it can be considered that a lever arm extends between pivot 73 and any given point of groove 94. Accordingly, the lever arm is of increasing length as initial end 95 is approached. It will be appreciated, therefore, by those skilled in the art, that the slower speed and greater force is generated nearer the closed position. Similarly, it will be apparent that greater speed is generated by tailgate 63 as it approaches the terminal open position, which in accordance with the immediately preferred embodiment, is approximately 90° from the closed position. It will also be appreciated by those skilled in the art that opening of tailgate 63 is in response to operating rod 85 being driven in the direction of arrowed line C in response to the entrance of pressurized fluid through port 89. Accordingly, it is recognized that should a leak in the control valve (to be described later) develop causing pressurization of fluid in cylinder 83, tailgate 63 will remain in the closed position. This result is achieved, of course, since the force resultant from pressure at the rear of the piston attached to operating rod 85 is greater than the force resultant from the equal pressure on the front by the product of the area of the rod 85 times the fluid pressure.

To assist in the discharge of refuse material within body 50 after the opening of tailgate 63, body 50 is tiltable in accordance with conventional practice.

THE HOPPER

Hopper 57, integrally the forward most portion of body 50 as seen in FIGS. 1 and 16, has a floor or bottom 110 which is an extension of lower horizontal panel 52. Edge 112 of floor 110 is an approximate half circle about an axis of rotation illustrated by the broken line F of which further description will be made presently. Main wall 113, being semicircular and upstanding from edge 112, terminates at either end with approximate diametrically opposed upright edges 114. The edges 114 are coincident with the forward edges of upright side panels 53. Upper edge 115 of main wall 113 resides at an elevation below upper horizontal panel 54. Inclined panel 117 extends from the forward edge of upper horizontal panel 54, at forward reinforcing member 67, forwardly downward to lower edge 118 which is substantially parallel to floor 110 and slightly forward the axis F. Thus, opening 119, communicating between hopper 57 and the receptacle portion of the body 50, is defined by floor 110, the upright edges 114, and the horizontal edge 118.

On the curb side 35, main wall 113 is interrupted by inwardly upwardly sloping panel 130. Otherwise, the effective height of main wall 113 is increased by screen 122 which may be conveniently fabricated of expanded metal or similar material of suitable strength. Inclined panel 117, while cooperating with the several other panels to form the receptacle portion of body 50, is also considered to be a portion of hopper 57. Sloping panel 120 cooperates with loader assembly 58 in the handling of refuse containers as will be hereinafter described in greater detail. As a salient feature, hopper wall 113 imparts a curved front to body 50 thereby providing that the operator of the vehicle may sit in the conventional left-hand driver's position while manipulating the vehicle with an unobstructed view of the handling of the curb side refuse container. Further, the left-hand operator's station, combined with the expanded metal screen 122, allows the operator to observe material flowing out of the container and into hopper 57.

PACKER MECHANISM

Platen 130, carried by shaft 132, resides within hopper 57, as viewed in FIG. 16. Shaft 132 is journaled for rotation about the axis illustrated by the broken line F. As will be appreciated by those skilled in the art and in accordance with conventional practice although not specifically herein illustrated, shaft 132 is supported by a pair of bearings, such as a conventional self-aligning type, secured to floor 110 and panel 117, respectively. As will be appreciated by those skilled in the art, the lower bearing is carried on the underside of floor 110 and may be reinforced by a subframe assembly. Platen 130 includes panel 133 having a height sized to be received through the opening 119.

Shoe 134, extending along the free vertical edge of panel 133, is curved in cross-section to mate with the interior surface of wall 113. Accordingly, as platen 130 rotates shoe 134 wipes the inner upright surface of hopper 57. Similarly, the lower horizontal edge 135 of platen 130 wipes floor 110. The term "wipe", as used herein, is satisfied by two elements which move in close proximity but do not necessarily contact.

Shaft 132 includes enlarged splined section 137 extending below floor 110. A cylindrical collar 138, being internally splined, is matingly engagable with splined section 137. First and second sheaves 139 and 140, respectively, are rotatably affixed to collar 138. Typically, sheaves 139 and 140 are provided with peripheral grooves 142 and 143, respectively. Atypically, however, grooves 142 and 143 are eccentric with respect to the axis of rotation F. The peripheral grooves 142 and 143 share a common profile but in reversed direction. The foregoing and other aspects of the eccentricity will be explained in further detail as the description precedes.

Sheaves 139 and 140 are sandwiched between upper and lower shield disks 144 and 145, respectively. First and second hydraulic cylinder assemblies 147 and 148, respectively, each having a cylinder 149 and a reciprocally movable operating rod 150, are carried on the underside of body 50. A first cable 152, partially residing within groove 142, is secured at one end thereof to operating rod 150, and at the other end thereof to sheave 139. Similarly, a second cable 153 extends between second cylinder 148 and second sheave 140 and partially resides within groove 143.

Each cylinder 149 is provided with a forward port 154 and a rearward port 155. Introduction of pressurized fluid into either cylinder 149 through the forward port 154 will result in retraction, movement in a direction of arrowed line G, of the corresponding operating rod 150. Accordingly, introduction of pressurized fluid into port 154 of hydraulic cylinder assembly 147 will result in the movement of cable 152 in a direction of arrowed line G urging rotation of sheave 139 in the direction indicated by the arrowed line H. Similarly, pressurized fluid entering cylinder assembly 148 through port 154 will result in the movement of cable 153 in the direction of arrowed line G with the resultant rotation of sheave 140 in a direction indicated by arrowed line I. It is noted that the direction of rotation indicated by the arrowed line I is counter to the direction of rotation indicated by the arrowed line H. It is apparent, therefore, that reciprocal rotary motion is imparted to platen 130 in response to the cyclic alternating supply of pressurized fluid to ports 154.

Various means, including manual, are available for cyclicly alternating the supply of pressurized fluid between cylinder assemblies 147 and 148. In accordance with an immediately preferred embodiment of the invention, a cross-over line 157 communicates between ports 155. Each port 154 is connected through a corresponding feeder line 158 with a conventional hydraulic control valve such as the one commercially available by the designation "Racine 1 1/4 Pilot operated MD20-HANC-AD12VDC". Supply line 160 communicates between control valve 159 and the on-board supply of pressurized fluid as will be understood by those skilled in the art.

Semischematically represented in FIG. 16 is a conventional normally open limit switch 162 which is conveniently mounted at an appropriate location on the underside of body 50 in accordance with standard practice. A pair of opposed limit switch actuators 163 are carried by disk 145. As will be appreciated by those skilled in the art, control valve 159 is operated in response to limit switch 162. In other words, as platen 130 rotates in the direction of arrowed line I, control valve 159 is supplying pressurized hydraulic fluid to cylinder assembly 148. Rotation continues until actuator 163 contacts and closes limit switch 162. Upon receipt of a signal from limit switch 162, control valve 159 alternates, discontinuing the flow of fluid to cylinder 148 and commencing flow of fluid to cylinder 147 thereby initiating movement in the direction of arrowed line H. Accordingly, platen 130 reciprocates through approximately 180°.

The speed of rotation of platen 130 and the force exerted thereby are variable. Due to the elliptical profile of the sheaves 139 and 140, the radial distance from axis F to either peripheral groove 142 and 143 is constantly variable. As will be appreciated by those skilled in the art, the greater the length of the radius, the distance from axis F to a given point on the peripheral groove, the slower the movement and the greater the torque, or force, applied to platen 130. Conversely, the shorter the radius, the faster but less forceful the movement of platen 130.

The minimum limits of rotation of platen 130 are roughly defined as being aligned with the lower edge 118 of inclined panel 117. Accordingly, limit switch 162 and actuators 163 are oriented such that platen 130 reciprocally rotates through an arc of approximately 180°. It is preferred, however, for reasons to be explained presently, that platen 130 reciprocally rotates through an arc of approximately 200°.

For purposes of discussion, platen 130 can be considered as having a recurring two-cycle operation. Each cycle is in response to the rotation of one of the sheaves as the result of the power stroke, retraction of the operating rod 150, of the associated hydraulic cylinder assembly. The cycles are coterminus; the termination of one cycle being the initiation of the next and alternately occuring at the limits of rotation.

Sheaves 139 and 140 are oriented such that the maximum radius,the distance from axis F to the point of tangency of the respective cable, coincides with the limits of travel of platen 130. The minimum radius corresponds with the initiation of movement or new cycle of platen 130. Accordingly, the speed of platen 130 decreases throughout the cycle. The applied force, or torque, is inversely proportional to the speed. During the entire cycle, platen 130 sweeps loose, uncompacted material from the hopper and directs the material through opening 119. As the line of applied force, normal to the side of platen 130, is directed toward the interior of body 50, greater pressure is generated, packing the accumulated material against material previously swept into the body 50.

THE LADDER ASSEMBLY

Referring now to FIG. 13, there is seen a ladder assembly, generally designated by the reference character 170, carried at a forward portion of body 50 for convenience of the operator or service personnel for inspection of or entrance into hopper 57. In accordance with an immediately preferred embodiment thereof, assembly 170 includes a ladder, or climbing structure, 172, which in general analogy to conventional practice, includes first and second stiles 173 and 174, respectively, having a plurality of rungs 175 extending therebetween. For convenience, ladder 172 may be a weldment of metallic bar stock.

The upper and lower ends of stile 173 are pivotably journaled within brackets 177 affixed to wall 133. Although only the upper end of assembly 170 is illustrated, the configuration of the lower portion thereof is easily visualized. By virtue of the pivotal mounting of stile 173, ladder 172 is rotatably movable, as designated by the double arrowed line J, between a use position shown in solid outline and a non-use position shown in broken outline. A detent, such as spring catch 178, releasably holds ladder 172 in the use position while a similar detent 179 releasably retains ladder 172 in the non-use position. In the non-use position, rungs 175 substantially abut wall 113 thereby rendering nearly impossible the placement of a foot upon said rung. In the use position, rungs 175 are spaced sufficiently from wall 113 to accommodate the foot of the climber. The variance between the positions is the result of cooperation between the positions is the result of cooperation between an eccentric pivot within bracket 177 and the angularly directed terminal portion 180 of stile 174.

Switch 182, which may be of a conventional normally closed momentary contact type, is secured to wall 113. Switch 182 is placed in series with the electrical circuit associated with the previously described packer mechanism. Further, switch 182 is positioned to be contacted by ladder 172, such as the terminal portion 180 of stile 174, when said ladder is placed in the use position. Hence, for purposes of safety, packer mechanism 159 is rendered inoperative at such time as personnel access is available.

LOADER ASSEMBLY

Figure 2:
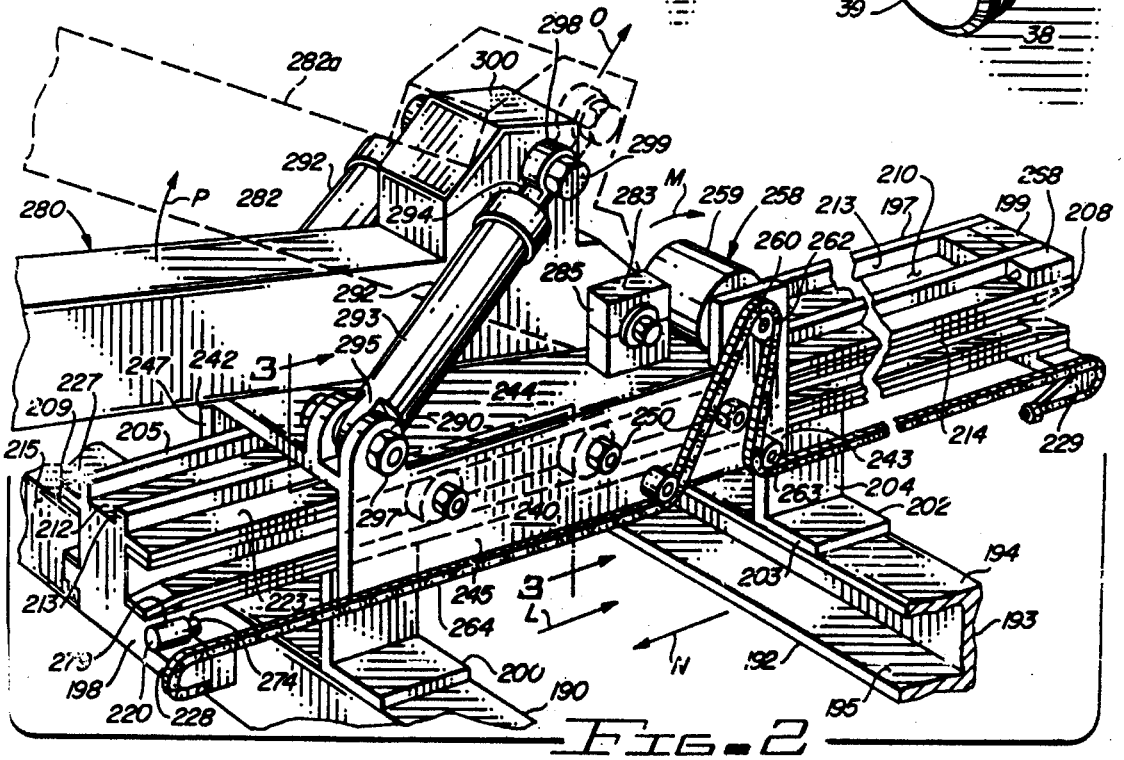
FIG. 2 is an enlarged, fragmentary, perspective view of the portion of the loader assembly directly connected to the vehicle.

The frame 37 of chassis 30, as viewed in FIG. 2, includes a pair of spaced apart parallel longerons 190, 192. For purposes of orientation, longeron 190 is nearer curbside. Preferably, each longeron is generally C-shaped in cross-section having an outboard vertical component 193 and inwardly directed upper and lower horizontal components 194 and 195, respectively.

Elongate beam 197, extending traversely of frame 37 and having curbside directed first end 198 and streetside directed second end 199, is supported upon longerons 190 and 192 by first and second pairs of pedestals 230 and 202, respectively. Each pedestal 200 and 202 is generally angular having a horizontal component 203 and an upright component 204. Each component 203 is secured to the respective upper horizontal component 194 and each upright component 204 is secured to beam 197 as by welding or other expedient mean. Although only one of each pedestal 200 and 202 is seen in FIG. 2, it will be appreciated that each is one of a mated pair.

Figure 3:
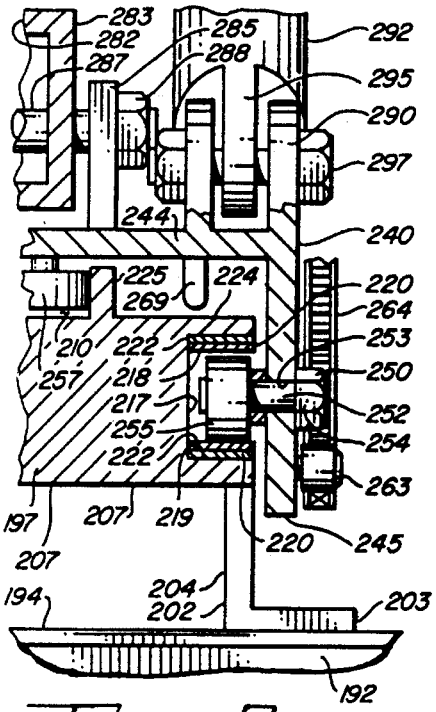
FIG. 3 is an enlarged fragmentary, vertical, sectional view taken along the line 3—3 of FIG. 2.

Being generally rectangular in cross-section, as further viewed in FIG. 3, beam 197 includes top 205, bottom 207, forward side 208 and rearward side 209. Groove 210, being U-shaped in cross-section having bottom 212 and upright sidewalls 213, is formed in and extends longitudinally of top 205. Grooves 214 and 215 extend longitudinally of forward side 208 and rearward side 209, respectively. The grooves 214 and 215 are generally C-shaped mirror images, each having upright wall 217, upper horizontal surface 218 and lower horizontal surface 219.

A pair of elongate gibs, secondary gib 220 and primary gib 222, are carried upon each lower surface 218 and each upper surface 219. Primary gib 222 functions as a hardened wear surface as will be understood presently, while secondary gib 220 functions as a shim, being available in various thicknesses. A notch 223, generally L-shaped in cross-section having horizontal surface 224 and vertical surface 225, extends along the upper forward edge of beam 197. A similar mirror image notch 227 extends along the upper rearward edge of beam 197. A first projection 228 extends forwardly from the lower portion of first end 198. A second projection 229 extends forwardly from the lower portion of second end 199. The purpose and function of the several grooves, notches and projections will become evident as the description precedes.

A carriage 240 is reciprocally, movably mounted upon beam 197. Carriage 240, having curbside or first end 242 and street-side or second end 243, is generally in the shape of inverted channel straddling beam 197 and including base plate 244 from which depends forward skirt 245 and rearward skirt 247. The skirts 245 and 247 are adjacent the forward side 208 and rearward side 209, respectively, of beam 197.

A plurality of roller assemblies 250 carried by skirts 245 and 247 support and guide carriage 240 along beam 197. Each roller assembly 250, as best viewed in FIG. 3, includes a shank 252 extending through an appropriately sized opening 253. The shank 252 is attached by nut 254 secured to the external end of shank 252. Cylindrical roller 255 is rotatably journaled to the inboard end of shank 252 and resides within groove 214. Although not specifically herein illustrated, additional roller assemblies 250 are carried by skirt 247 and cooperate with groove 215. In each case, the rollers 255 bear upon the respective gibs 222 to support the weight of carriage 240 and the mechanism carried thereby. A plurality of secondary roller assemblies 257, generally analogous to the primary roller assemblies 250, are affixed to base plate 244 and cooperate with groove 210 for additional stability of carriage 240.

Mounting bracket 258, an extension of forward skirt 245 projecting above base plate 244, supports motor 259. Shaft 260, rotatably driven by motor 259 and extending through bracket 258, has sprocket 262 affixed thereto. It is noted that the axis of rotation of shaft 260 is substantially parallel to base plate 244 when viewed in one direction and substantially perpendicular to the axis of beam 197 when viewed in another direction. A pair of idlers 263 are secured to forward skirt 245 proximate the lower edge thereof for rotation about an axis parallel to the axis of shaft 260. A roller chain 264 is secured at one end to first projection 228 and at the other end to projection 229. Intermediate the ends thereof, roller chain 264 passes under each idler 263 and upwardly over and engaged with sprocket 262.

Rotation of motor 259 in the direction indicated by the arrowed line K results in movement of carriage 240 in the direction indicated by the arrowed line L toward end 199 of beam 197. Pursuant to rotation of motor 259 in a direction indicated by arrowed line M, counter to the direction of arrowed line K, carriage 240 moves toward end 198 of beam 197 as indicated by the arrowed line N. A first switch 268 is mounted to beam 197 proximate the second end 199. Finger 269 is carried by carriage 240. Switch 268 functions as a limit switch while finger 269 functions as an actuator for the switch. As will be readily appreciated without further detailed description, carriage 240 moves in the direction designated by the arrowed line L until finger 269 touches and activates the switch. At that time, the movement of carriage 240 is discontinued and the carriage 240 remains inert until reactivated by the operator; of which further description will be made hereinafter.

A stop 272 is carried by projection 228. In accordance with an immediately preferred embodiment, stop 272 includes tubular housing 273 from which projects cushion element 274. Cushion element 274 is readily fabricated of any material having suitable resiliency such as neoprene, teflon or nylon. Stop 272 limits the movement of carriage 240 in the direction of arrowed line N.

Figure 4:
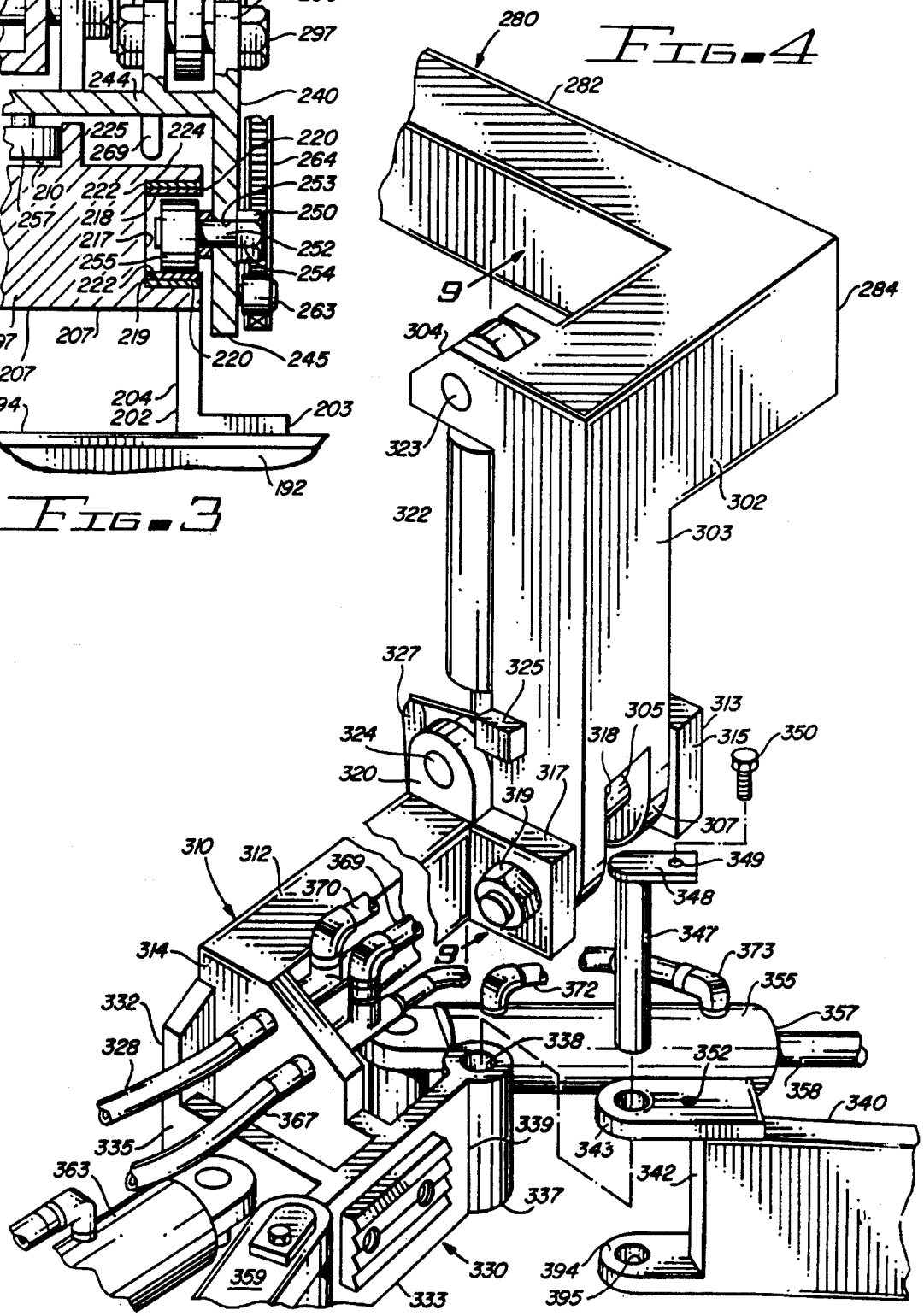
FIG. 4 is an enlarged, partially exploded, fragmentary, perspective view of the free end of the loader assembly seen in FIG. 2.

A lift assembly, generally designated by the reference character 280, including lifting arm 282 having fixed end 283 and free end 284, as seen in FIG. 4, is carried upon carriage 240. As particularly seen in FIGS. 2 and 3, free end 283 resides between a pair of bearing supports 285 projecting upwardly from base plate 244. Pin 287, passing through appropriately sized openings in free end 283 and bearing supports 285, provides pivotal attachment between carriage 240 and arm 282. To prevent lateral dislodgement, pin 287 is provided, at either end, with a threaded aperture for receiving a bolt 288. Although only one bearing support 285 and one bolt 288 are illustrated, it will be appreciated that each is one of a pair having free end 283 of arm 282 therebetween. The axis of rotation of arm 282 about pin 287 is generally parallel to the longitudinal axis of chassis 30.

A pair of bifurcated mounting brackets 290 project upwardly from proximate the first end 242 of carriage 240. Although only one bracket 290 is specifically seen in the drawings, it will be appreciated that a bracket 290 resides on either side of arm 282. A hydraulic cylinder assembly 292 resides on either side of arm 282. Each cylinder assembly 292 includes a cylinder 293 and reciprocally movable operating rod 294 which is extendable in response to the introduction of pressurized fluid into cylinder 293 in accordance with conventional practice. Cylinder 292 terminates at one end with attachment member 295 pivotably secured to bifurcated bracket 290 by bolt and nut assembly 297. Operating rod 294 terminates at the free end with eye 298. Bolt 299 projecting through eye 298 is threadedly engaged with boss 300 projecting from arm 282 proximate the fixed end thereof.

With cylinder assembly 292 in the retraction position, arm 282 resides in a substantially horizontal orientation. In response to the introduction of pressurized fluid into cylinder 293, rod 294 is extended in the direction indicated by the arrowed line O urging arm 282 to pivot about the axis provided by pin 287 as indicated by the arrowed line P to an elevated position as suggested by the broken outline **282*a*. Boss 300 increases the trilateral distance of the three pivotal points formed by pin 287, bolt 297 and bolt 299 to provide an increase in the rotational torque generated by hydraulic cylinder assembly 292**.

Figure 5:
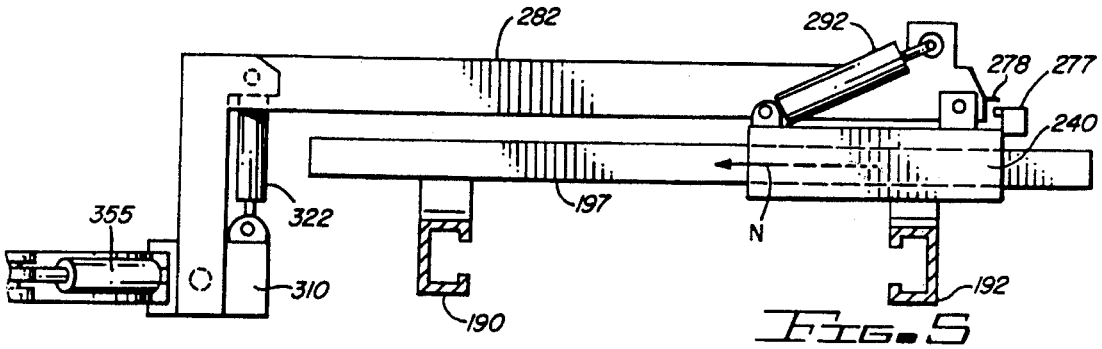
FIG. 5 is a semischematic representation of the loader assembly of the instant invention as it would appear in the substantially horizontal rest position.
Figure 6:
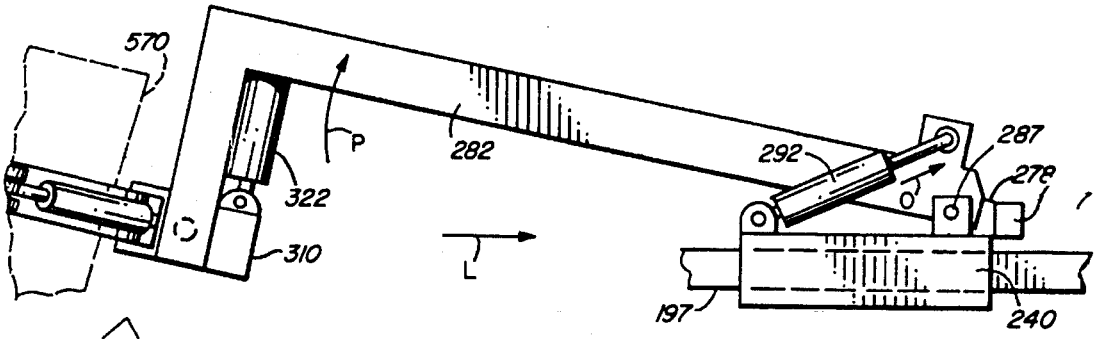
FIG. 6 is a semischematic illustration generally corresponding to the illustration of FIG. 5 and showing the loader assembly as it would appear after commencing the lifting of a refuse container.

Schematically represented in FIGS. 5 and 6 is limit switch 277 affixed to carriage 240. Actuator 278 is carried by arm 282. As will be described in further detail presently, arm 282 pivots in the direction indicated by the arrowed line P until actuator 278 contacts and opens switch 277. Upon the opening of switch 277, the supply of fluid to cylinder 292 is discontinued and arm 282 remains stationary until reactivated by the operator. As will be appreciated by those skilled in the art, switch 277 and activator 278 are positioned such that the movement of arm 282, in the direction of arrowed line P, is through an arc of predetermined degrees.

As especially noted in FIG. 4, free end 284 of arm 282 concludes with rearwardly directed intermediate section 302 and downwardly directed terminal portion 303. Bifurcated mounting bracket 304 is carried proximate the intersection of intermediate section 302 and terminal portion 303. Bore 305 extends through terminal portion 303 proximate the lower end 307 thereof.

Tilt assembly 310 is carried by lift assembly 280. More specifically, tilt assembly 310 includes subframe 312 which is pivotally secured to the free end 284 of arm 282. Subframe 312 is generally elongate and horizontal having forward end 313 and rearward end 314. Mounting plates 315 and 317 receive the lower end 307 of terminal portion 303 therebetween. Pin 318 projects through bore 305 and aligned bores (not specifically illustrated) in plates 315 and 317. Each end of pin 318 is threaded to receive a nut 319. Also carried proximate the free end 313 of subframe 312 is bifurcated mounting bracket 320. Hydraulic cylinder assembly 322 extends between brackets 304 and 320 being pivotally connected at respective ends by pins 323 and 324 in accordance with conventional practice and as previously described herein.

In accordance with the foregoing, it is apparent that tilt assembly 310 is rotatable about the axis of pin 318 in response to operation of hydraulic cylinder assembly 322. Switch 325, a limit switch having indirect control over the flow of hydraulic fluid into cylinder assembly 322, is affixed to terminal portion 303 of arm 282. Finger 327, functioning as an actuating element for switch 325, is carried by frame 312. Further description of the function of switch 325 and the interaction thereof with cylinder assembly 322 will be made presently.

In addition to the previously described function, frame 312 functions as the base for clamp assembly 330. An attachment element 332, as clearly illustrated in FIGS. 4 and 11, projects outboard from rearward end 314 of subframe 312 and terminates with substantially upright plate 333. Element 332 further includes substantially upright forward and rearward sides 334 and 335, respectively.

A cylindrical element 337, having bore 338, is integral with the forward edge 339 of plate 333. Gripping arm 340 is provided with a bifurcated inner end 342 having upper and lower furcations 343 and 344, respectively, spaced to receive cylindrical element 337 therebetween. Bore 345 passes through furcations 343 and 344. Pin 347 passes through bores 345 and 338 thereby pivotably connecting gripping arm 340 to subframe 312. Tab 348 secured to one end of pin 347 and having opening 349 therethrough is receivable against furcation 343. Bolt 350 passes through opening 349 and is threadedly engaged within opening 352 for retention of pin 347.

A mounting bracket 353 is secured to forward side 334 of attachment element 332. A mounting bracket 354 is integral with the outer side of gripping arm 340. A hydraulic cylinder assembly 355, having the conventional cylinder 357 and operating rod 358, is pivotably secured at respective ends to brackets 353 and 354 by bolts or pins in accordance with previously described conventional techniques.

A second gripping arm 359 operatively opposes gripping arm 340. Associated with gripping arm 359 is bifurcated end 360, pin 362 and hydraulic cylinder assembly 363 extending between mounting brackets 364 and 365. Gripping arm 359 and the components associated therewith are mirror images of the corresponding components described in connection with gripping arm 340. Hydraulic cylinder assembly 363, in general similarity to hydraulic cylinder 358, is provided with first and second intake ports 372 and 373, respectively.

As used herein in connection with the various elements of clamping assembly 330, the terms "upright" or "vertical" refer to the normal, special orientation when lift assembly 280 is in the lowered, or rest, position. Included are the axes of the pivotal connections of the cylinder assemblies 357 and 363. More specifically, the immediately considered axes are perpendicular to the axis of pin 350 and deviate from upright or vertical in response to rotation of previously described components about the axes of pins 305 and 287.

First intake ports 372 of the hydraulic cylinder assemblies 355 and 363 are interconnected through line 367. Line 368 communicates between second intake ports 373 of each hydraulic cylinder assembly. Pressurized hydraulic fluid is selectively provided to lines 367 and 368 through supply lines 369 and 370, respectively. In accordance with conventional practice, the several lines may be in the form of flexible hoses joined by appropriately selected rigid fittings.

Arms 340 and 259 cooperate to grasp and hold a refuse container. As viewed in FIGS. 1 and 11, the arms 340 and 359 are at an intermediate position. In the retracted, or rest, position, normally assumed during transport of the refuse collection vehicle, the arms are retracted until the four ends, each end of each arm, lie in an approximate straight line. As will be appreciated by those skilled in the art, retraction is affected through the introduction of pressurized fluid into second ports 373. In response to the introduction of pressurized fluid into first ports 372, each rod 358 extends as indicated by the arrowed lines R urging pivotal rotation of the arms as into the closed, or gripping, position as indicated by the arrowed lines S.

THE CONTROL CONSOLE

As previously noted, the instant invention contemplates that the operator of the refuse collection vehicle be seated at the left-hand side of the cab, the standard driver's position of conventional motor vehicles. Due in part to the window area of the cab and the rounded forward wall of the body, the operator is afforded an unobstructed view of a refuse container during the entire loading cycle. For operative control of the loading cycle, and of other functions, a console is positioned to the right of the operator for single-handed manipulation while observing the resultant functions. Concurrently, the other hand and both feet are available for the normal driver operated controls, such as the steering wheel, throttle and brake, of the vehicle.

Figure 17:
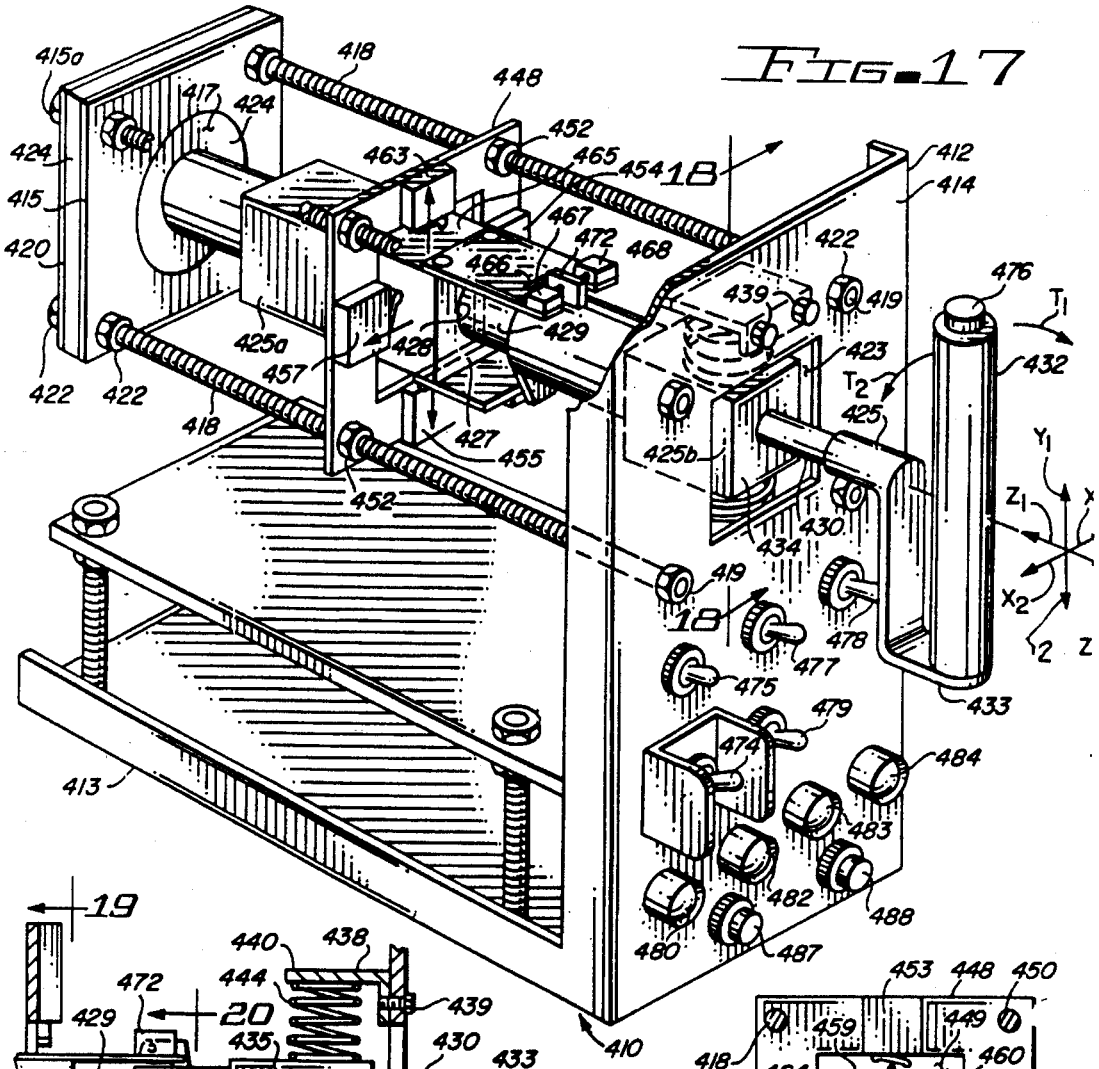
FIG. 17 is a perspective view of a counsel for controlling the refuse collection system of the instant invention, the outer cover being removed for purposes of illustration.

Turning now to FIG. 17, there is seen a console generally designated by the reference character 410 contemplated by the instant invention as suitable for the foregoing purpose. Housing 412, having base 413 and upright face panel 414, may be especially fabricated for the purpose or, alternately, be an appropriately chosen model of a commercially available device commonly referred to as a "chassis box". Commercially available chassis boxes are generally separable, by removal of a number of sheet metal screws, into two components. In the immediate illustration, that portion of the structure carrying the sides, top and back has been removed for purposes of clarity.

Plate 415, having central opening 417, is held in parallel spaced relationship to face panel 414 by mounting means, which in accordance with an immediately preferred embodiment of the invention, includes four equally spaced parallel threaded rods 418. Each rod 418 includes a first end 419 projecting through an appropriately sized opening in panel 414 and a second end 420 extending through an opening in plate 415. First end 419 is secured by a pair of nuts 422 placed on opposite sides of and tightened against the panel 414. For purposes of appearance, acorn nuts may be used on the outer side of face panel 414.

An opening 423 is formed through panel 414 at a location generally intermediate ends 419 of rods 418 and opposite opening 417 in plate 415. A flexible element 424, such as may be fabricated of conventional neoprene impregnated cloth diaphragm material, extends across opening 417. Flexible element 424 is sandwiched between plate 415 and a backup plate **415*a*, the latter being identical to plate 415. In general similarity to first end 419, second end 420, of each rod 418, is secured by a pair of nuts 422 placed on opposite sides of plates 415 and 415*a*. A shaft 425, having first section 425*a* and second section 425*b*, extends through opening 423 and is substantially parallel with rods 418. First section 425*a* terminates with inner and outer ends 426 and 427, respectively. Inner end 426 abuts and is stationarily affixed to flexible element 424 in accordance with conventional practice by a bolt, not herein specifically illustrated, passing through element 424 and threadedly engaging end 426. If desired, first section 425*a* may be further stabilized against movement relative flexible element 424 by the use of one or more dowel pins in accordance with conventional practice. Cylindrical, axially aligned bore 428 extends inwardly from end 427. Second section 425*b* terminates at the inner end with cylindrical section 429 and at the outer end with stem 430. Stem 430 extends through opening 423. An elongate handle 432, residing external of housing 412, is secured to stem 430 by means of bracket 433**.

Cylindrical section 429 is journaled within bore 428. Hence, second section **425*b* is rotatably and slidably movable relative first section 425*a***.

Handle 432 is movable as will be described presently. In the normal, or rest, position, the longitudinal axis of handle 432 is perpendicularly intersected by the axis of shaft 425. Further, the axis of shaft 425 substantially bisects the length of handle 432. Accordingly, the longitudinal axis of shaft 425 approximately coincides with the axis of rotation of the operator's wrist when the fist is engaged about handle 432. Those skilled in the art will immediately appreciate the benefits of convenience and comfort of the operator.

Figure 18:
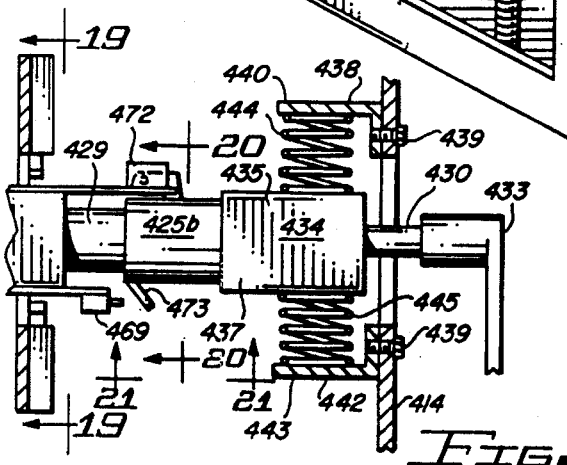
FIG. 18 is a fragmentary, vertical, sectional view, on a reduced scale, taken along the line 18—18 of FIG. 17.

A block portion 434, as further seen in FIG. 18, having upper surface 435 and lower surface 437, is carried by second section **425*b* proximate the inner side of face panel 414. An angle bracket 438, secured to panel 414 in accordance with conventional practice by screws 439, includes inwardly extending plate 440 residing in spaced parallel relationship with surface 435. A second angle bracket 442, also secured to panel 414 by screws 439, carries plate 443 opposing surface 437. Compression spring 444 resides between surface 435 and plate 440. Similarly, compression spring 445 is held between surface 437 and plate 443. Resultingly, handle 432** is held in the normal, or rest, position previously described.

As a result of the mounting against flexible element 424 and between springs 444 and 445, handle 432 and concurrently shaft 425, are movable in the directions of the conventional lateral and vertical axes as indicated by the symbol 447. For reference, the lateral directions, right and left, are indicated by the arrowed lines $X_1$ and $X_2$, respectively. Up and down, the vertical axes, are indicated by the arrowed lines $Y_1$ and $Y_2$, respectively.

As a result of the relative rigidity of flexible member 424 and the journaling of cylindrical section 429 within bore 428, second section **425*b* is movable relative first section 425*a*. The movement is in and out, along the longitudinal axes, as indicated by the arrowed lines $Z_1$ and $Z_2$, respectively, and rotational movement to the right as suggested by the arrowed line $T_1$ and to the left as indicated by the arrowed line $T_2$. It will be appreciated that the operator, holding handle 432, can affect concurrent movement in more than one direction. Further, upon release of handle 432, shaft 425** is self-centering.

Figure 19:
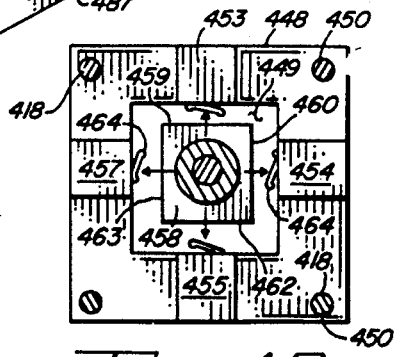
FIG. 19 is a vertical, sectional view taken along the line 19—19 of FIG. 18.
Figure 20:
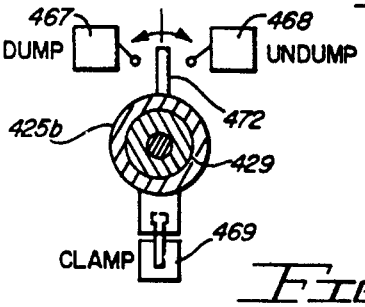
FIG. 20 is a fragmentary, vertical, sectional view taken along the line 20—20 of FIG. 18.
Figure 21:
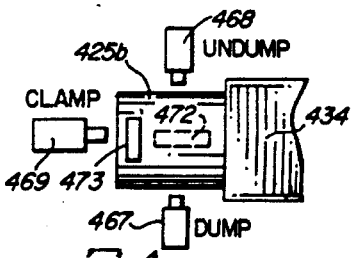
FIG. 21 is a fragmentary, horizontal, sectional view taken along the line 21—21 of FIG. 18.

With reference to FIGS. 17 and 19, there is seen a switch mounting plate 448 carried by the several rods 418. Extending through plate 448 is a generally central opening 449 and four spaced apertures 450, each receiving a respective rod 418 therethrough. Plate 448 is positionally fixed by a pair of nuts 452 carried by each shaft 418, one on either side of plate 448.

First, second, third and fourth momentary contact switches 453, 454, 455 and 457, respectively, are carried by plate 448. A camming member 458, being generally rectangular in cross-section and having first, second, third and fourth cam surfaces 459, 460, 462 and 463, respectively, is carried by first section **425*a* of shaft 425 projecting through opening 449. Each switch 453, 454, 455 and 457 includes an inwardly directed actuating element 464**. As will be appreciated by those skilled in the art, the several switches are of a commercially available type commonly referred to as "microswitches".

A second switch mounting plate 465 is secured to first cam surface 459 of camming member 458 and extends forwardly therefrom over second section **425*b*. Plate 465 is bifurcated by longitudinally extending slot 466. Fifth switch 467 and sixth switch 468 are carried by respective furcations on opposite sides of the slot 466. A seventh switch 469 is carried by third mounting plate 470 which is secured to and extends forwardly from third cam surface 462. Both plates 465 and 470 are secured to camming member 458 in accordance with conventional means such as screws 471. Integral with each switch is the actuating element 464**.

Cam element 472, extending radially from second section **425*b* extends upwardly through slot 466 and resides between fifth switch 467 and sixth switch 468. It is noted that the actuating elements 464 of switches 467 and 468 are in opposed relationship. Cam 473, an annular segment depending from second section 425*b*, is spaced forwardly with respect to switch 469. An eighth switch, carried within handle 432, is evidenced by button 476 projecting from the free end of handle 432**.

In response to movement of handle 432 in the direction of arrowed line $Y_1$, first camming surface 459 moves the actuating element 464 of first switch 453. Similarly, second switch 454 is activated in response to second cam surface 460, third switch 455 is contacted and activated by third cam surface 462 and fourth switch 457 is activated by fourth cam surface 463 in response to movement in the direction of arrowed lines $X_1$, $Y_2$ and $X_2$, respectively. Fifth switch 467 and sixth switch 468 are activated by radial cam 472 in response to rotation of handle 432 in the direction of arrowed lines $T_1$ and $T_2$, respectively. Movement of handle 432 in the direction of arrowed line $Z_1$ urges annular cam 473 into activation position with seventh switch 469, which activation is released in response to movement of handle 432 in the direction of arrowed line $Z_2$.

For a given movement of handle 432 in either X or Y directions, the end of camming member 458 nearer end 423 of shaft 425 moves a greater distance than the end of camming member 458 nearer end 427 of shaft 425. Accordingly, the sensitivity, or the length of movement of handle 432 for activation of the switches carried by plate 448, is readily adjustable by the movement of plate 448 along rods 418. Sensitivity is also variable in response to the rate of springs 444 and 445 and the resilience of flexible member 424.

The functions controlled by the foregoing switches will be described presently. Several other switches are also carried by the console. First and second two-position toggle switches 474, 475, respectively, are carried by face panel 414. First, second and third three-position toggle switches 477, 478 and 479, respectively, are also affixed to face panel 414. Also evidenced are four fuse holders 480, 482, 483, and 484 and first and second indicator lights 487 and 488, respectively. For purposes of operator distinction, first light 487 may be green while second light 488 is red.

OPERATION AND CONTROL

Various means for controllably supplying pressurized hydraulic fluid to the various actuating elements for operation of the structure of the instant invention will readily occur to those skilled in the art. The instant invention contemplates that the supply of pressurized hydraulic fluid is under central operator control by means of the console located within the cab of the vehicle. Preferred means and method of effecting an operative relationship between the operator manipulated controls carried by the console and the previously described operating structural elements of the refuse collection system of the instant invention will now be described with primary reference to the schematic illustration of FIG. 22. Various portions of the schematic, such as the wires communicating between the several switches illustrated in FIG. 2 and the electrically energized components of FIG. 22, are considered to be apparent to those skilled in the art and therefore omitted so as not to unduly complicate the drawings.

Figure 22:
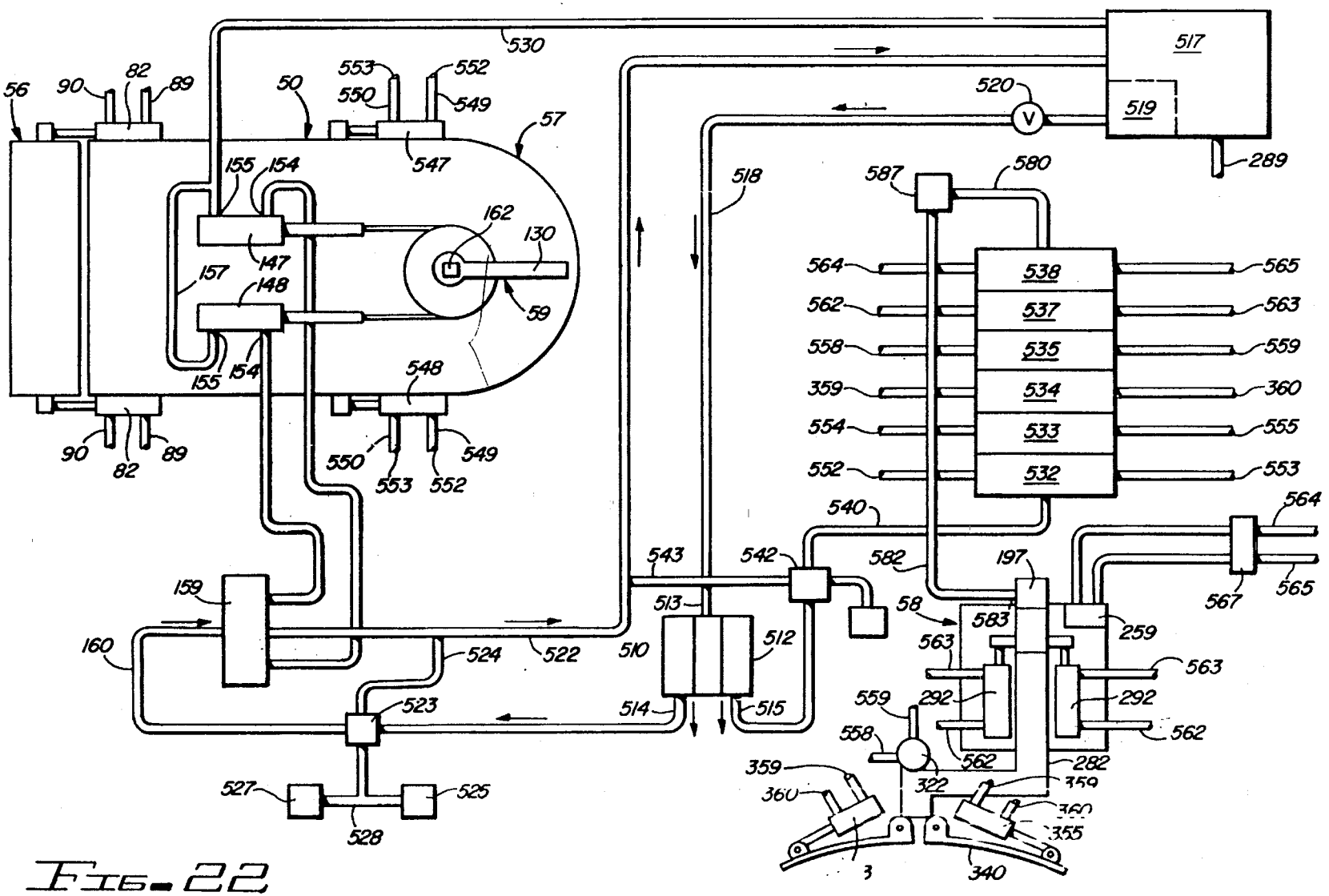
FIG. 22 is a schematic representation of a hydraulic system which can be used to actuate the refuse collection system of the instant invention.

With specific reference to FIG. 22, there is seen a first pump 510 and a second pump 512. In accordance with a preferred embodiment of the instant invention, each pump 510 and 512 is of the positive displacement type residing within a single housing and sharing a single inlet 513 but having separate outlets 514 and 515, respectively. Pumps of the immediate type are commercially available. Suitable for the immediate purpose is the pump marketed under the trade name VICKERS and identified by the designation G3020-7G-21D15D12B-31.

Also commercially available are various means for driving pumps of the foregoing type. For convenience of the operator, a chassis intended for the immediate purpose is generally provided with an automatic transmission. A power take-off unit, such as the one commercially available under the trade name CHELSEA 27kD, is readily attachable to the transmission by the mechanic of ordinary skill. The power take-off unit and the pump are connected by means of a drive line such as the commercially available Spicer Model 9553SP. The exemplary power take-off unit is designed to operate in an engine range of from approximately one thousand to two thousand revolutions per minute. For the prevention of damage, the apparatus may be provided with a speed controller for automatic disengagement at speeds above two thousand rpm. The speed controller regularly used with the instant invention also prevents engagement at any rpm above one thousand to further reduce damage to the apparatus.

A supply of hydraulic fluid for pumps 510 and 512 is maintained in reservoir 517 and made available to the common inlet 513 through primary supply line 518, having in series therewith filter 519 and cut-off valve 520. It is a feature of the previously designated commercially available dual pump that first pump 510 is substantially larger than second pump 512. In the invention, for example, operating at 1200 rpm, pump 510 delivers about 21 gallons per minute and pump 512 15 gallons per minute. Furthermore, pressure at outlet 514 may range to approximately 2500 pounds per square inch while maximum pressure available at outlet 515 is approximately 1500 pounds per square inch.

The operation of pumps 510 and 512 are under the immediate control of the operator with reference to console 412. As will be appreciated by those skilled in the art, a power take-off unit of the immediate type is engaged and disengaged by a clutch which is responsive to a solenoid (electrical coil) operated valve. The solenoid is under direct control of first two-position toggle switch 474. When the switch is moved to the on position and the power take-off unit engaged, first indicator light 487 is lighted. Obviously, switch 474 is rendered inoperative when the power take-off unit is disengaged in response to the previously described speed control device. In the interest of disclosure, speed control devices suitable for the immediate purpose, are commercially available under the trade name MUNCIE, and designated as Model EOS-100.

The sole function of pump 512 is the operation of packer mechanism 59. Supply line 160 communicates between outlet 515 of first pump 510 and the inlet of control valve 159. As previously described, control valve 159 alternately supplies pressurized hydraulic fluid to the forward intake ports 154 of hydraulic cylinder assemblies 147 and 148.

Return line 522 communicates between control valve 159 and reservoir 517. Relief valve 523 is placed in line in supply line 160 and communicates with return line 522 through bypass line 524. Normally open pressure responsive electric switch 525 and pressure gauge port 527 communicate with relief valve 523 through feeder line 528.

Normally, as previously described, platen 130 reciprocally rotates through the described arc in response to the alterations of valve 159 as triggered by the periodic impulses of limit switch 162. Switch 162 is actuated when platen 130 reaches the normal terminal position. As body 50 is filled with refuse, platen 130 is prohibited from reaching the normal terminal position. Accordingly, as will be appreciated by those skilled in the art, the continued attempt to urge platen 130 to the respective terminus will result in a continued increase in the pressure within the appropriate line 154. Upon the closing of switch 525, as a result of pressure reaching a preset value, an electric impulse is sent to valve 159 causing a reversal thereof. Concurrently, a sensible alarm, such as light 488, within console 412 is activated. Hence, the operator is alerted to the change in means of actuation and, hence, the growing compaction of the load. When the pressure exceeds the preadjusted setting, valve 523 will open providing for the relief of pressure through bypass line 524.

Packer mechanism 57 is directly under operator control by virtue of three-position switch 477 and second three-position switch 478. Centering three-position switch 477 concurrently centers valve 159 such that hydraulic fluid from supply line 160 passes directly through to return line 522. The placement of switch 477 at one limit established automatic operation as described immediately above. Placing switch 477 at the other limit places switch 478 within the immediate circuit for manual operation of the packer mechanism. In the manual mode, valve 159 alternates in direct response to alternating movement of switch 478 Preferably, connection is made such that movement of switch 478 to the right or to the left results in corresponding directional movement of platen 130.

It will be appreciated that any movement of platen 130 is in direct response to the pull of the operating rod of selected cylinder assembly 147 or 148. The pull of the operating rod is the result of the introduction of pressurized fluid through the respective port 154. Ports 155 and cross-over 157 are strictly for purposes of pressure relief and normally would not carry hydraulic fluid. It is inevitable, however, that with wear, leakage or bypass flow around the piston will occur. For this reason, cross-over line 157 communicates with reservoir 517 through vent line 530. Preferably, vent line 530 is attached to reservoir 517 at a position above the normal fluid level.

The other hydraulic elements of the system of the instant invention are actuated in response to first, second, third, fourth, fifth and sixth control valves 532, 533, 534, 535, 537, and 538, respectively. The several valves, which are series connected, are supplied pressurized hydraulic fluid from pump 512 through supply line 540. Pressure relief valve 542 directs hydraulic fluid through bypass line 543 to return line 522 in response to excessive pressure build-up in line 540.

Valves suitable for the immediate purpose are commercially available. Exemplary is the control valve distributed under the trade name RACINE and designated by the Model No. 995619E. Briefly, a valve of the immediate type is best described as an electrically actuated, solenoid operated, reciprocally movable, self-centering open center spool type valve. An intake port for receiving pressurized fluid from the supply line and an exhaust port communicating with the return line reside at an intermediate location of the valve body. The series arrangement of the instant invention is rendered possible by the constant flow between the intake port and the exhaust port of a grouping of valve bodies. The spool selectively diverts a portion of the fluid to one of the cylinder ports located at either end of the body. For purposes of discussion, it will be considered that each control valve, schematically illustrated in FIG. 22, has a first cylinder port at the left-hand end thereof and second cylinder port at the right-hand end thereof.

As previously described, refuse storage body 50, in accordance with conventional practice, is pivotally connected to chassis 30 for purposes of unloading. The body is tilted by hydraulic cylinder assemblies 547 and 548, each having first port 549 and second port 550, as schematically represented in FIG. 22. Line 552 communicates between the first cylinder port of valve 532 and the first intake ports 549 of cylinder assemblies 547 and 548. Line 553 communicates between the second cylinder port of valve 532 and the second intake ports 550 of cylinders 547 and 548. Line 554 communicates between the first cylinder port of valve 533 and first ports 89 of the cylinders 82. The second ports 90 of cylinders 82 are coupled with the second cylinder port of valve 533 through line 555. Valves 532 and 533 are responsive to toggle switches 474 and 479, respectively.

The body is unloaded by the operator sequentially or simultaneously moving toggle switches 474 and 478 to activate valves 532 and 533 to open the respective first cylinder ports. In response thereto pressurized fluid flowing through line 552 and entering ports 549 extending cylinder assemblies 547 and 548 thereby tilting body 50. In response to pressurized fluid from line 554 entering cylinders 82 through ports 89, the tailgate is unlocked and raised as previously described. Resultingly, the load compacted refuse, falls from body 50. Removal of the load may be assisted by concurrent operation of packer mechanism 59.

Subsequent to removal of the load, the vehicle is driven forwardly a few feet to be clear of the discharged load. The position of toggle switch 479 is now reversed switching valve 532 for discharge of pressurized fluid through line 553. Resultingly cylinder assemblies 547 and 548 are retracted lowering body 50 to the normal rest position. Reversal of switch 474 activates valve 533 for flow of fluid through line 555 and subsequent locking of the tailgate 63 as previously described. It is noted that, in connection with valves of the instant type, while one cylinder port communicates with the main supply line, the other cylinder port communicates with the return line.

Loader assembly 58 is caused to function by fluid flow directed by third, fourth, fifth and sixth control valves 534, 535, 537 and 538, respectively, in response to operator manipulation of handle 432. Previously described lines 359 and 360 associated with clamp assembly 330 are associated with first and second cylinder ports, respectively, of third valve assembly 534. Lines 558 and 559 communicate between the first and second cylinder ports, respectively, of valve 535 and hydraulic cylinder assembly 322. Lines 562 and 563 communicate between the cylinders 292 and the first and second cylinder ports, respectively, of fifth control valve 537. Lines 564 and 565, extending from the first and second cylinder ports, respectively, of sixth control valve 538, communicate with motor 259. Cross-port relief valve 567 is in series with lines 564 and 565.

Pressurized hydraulic fluid for the several series connected valves is delivered through,supply line 540 communicating between pump 512 and the intake port of the initial valve 532. The spent hydraulic fluid, having passed through the several valves, exits the exhaust port of the terminal valve 538 into return line 580 for routing to reservoir 517. The routing may be direct. That is, return line 580 may communicate directly between valve 538 and reservoir 517.

It is contemplated by the instant invention, however, that elongate support beam 197 is hollow. As will be appreciated by those skilled in the art, such a structure is readily fabricated as a weldment of steel plate of appropriate size and thickness to withstand the forces imparted thereto by carriage 240. In a prototype model, which yielded satisfactory results, beam 197 was fabricated of material having a wall thickness of 0.375 inches; the resultant structure having a square cross-section measuring four inches on each side. Being ninety-three inches long, the beam had an interior capacity of approximately 4.25 gallons.

Return line 580 is arranged to have a first section 582 communicating between the exhaust port of valve 538 and an inlet port 583 carried by beam 197. A second section 584 communicates between outlet port 585 of beam 197 and reservoir 517. A one-way check valve 587 resides within like 580. The use of beam 197 adds additional capacity to the hydraulic system and assists in cooling the hydraulic; fluid. It is not that the longitudinal grooves in beam 197 result in the formation of a plurality of longitudinally extending fins which increase the surface area for additional cooling.

Having set forth the structure, the function and method of handling a refuse container will now be described. For authenticity of description, it is assumed that the vehicle of the instant invention has been brought to a stop adjacent a container after having been driven from a previous location. Loader assembly 58 is in the transport position. That is, carriage 240 is fully retracted to streetside, or second end 199 of beam 197. Arm 282 is in the lowered, or substantially horizontal, position. Cylinder 322 is retracted such that tilt assembly 310 is substantially horizontal. Arms 340 and 359 of clamp assembly 330 are retracted to maximum position. Body 50 is lowered with tailgate assembly 56 in the locked position. Preferably, packer assembly 59 is in operation.

As an initial action, the operator urges handle 432 in the direction indicated by arrowed line $X_1$ thereby closing switch 454 causing valve 538 to direct fluid to line 564 energizing motor 259 for movement of carriage 240 in the curbside direction as indicated by the arrowed line N in FIG. 5. The limit of movement of carriage 240 in the direction of arrowed line N is determined by stop 272 as previously described. As the container is approached, handle 432 is concurrently urged in the direction indicated by the arrowed line $Z_1$, thereby closing switch 469 and activating valve 534 for the discharge of pressurized fluid through line 359 for commencement of the extension of hydraulic cylinder assemblies 355 and 369 urging the closing of arms 340 and 359. Ideally, the foregoing functions are completed simultaneously. That is, arm 282 has been extended the proper distance concurrent with clamp assembly 330 having firmly grasped the container.

It is generally considered that at the termination of the foregoing function carriage 240 will reside in an infinite position along beam 197. It is not generally expected that carriage 240 will achieve the limit of movement in the direction of arrowed line N. Should this occur, however, carriage 240 will abut stop 272 as a limit of travel. As incoming hydraulic fluid through line 564 to motor 259 builds to a pressure exceeding a preset maximum, the fluid will be routed through cross-port relief valve 567 to return line 565. Cross-port relief valve 567 limits hydraulic pressure to motor 259 to a preset maximum.

After the grasping of the container, handle 432 simultaneously moves in the directions indicated by the arrowed lines $Y_1$ and $X_2$. More precisely, the handle is moved at a compromise angular position between the directions such that switches 453 and 457 are simultaneously closed. It is within the scope of the invention that switches 453 and 456 may be closed sequentially, however, simultaneous actuation increases the speed of the operation. In response to the closing of switch 453, the first cylinder port of valve 537 is opened providing for the flow of pressurized fluid through line 562 for the extension of hydraulic cylinder assemblies 292 and the raising of art 282. The closing of switch 457 reverses valve 538 direction pressurized fluid through line 565, reversing the direction of motor 259 whereby carriage 240 is moved in the direction of arrowed line L as seen in FIG. 6. Further seen in FIG. 6 is the extension of cylinder 292 in the direction of arrowed line O and the raising of arm 282 in the direction of arrowed line P as it rotates above pivot pin 287. The limit of pivotal movement of arm 282 in the direction of arrowed line P is limited by the contact of actuating member 278 with switch 277. The limit of movement of carriage 240 in the direction of arrowed line L is determined by limit switch 268 in series between switch 457 and valve 538. A typical refuse container is represented by the broken outline 570.

Figure 7:
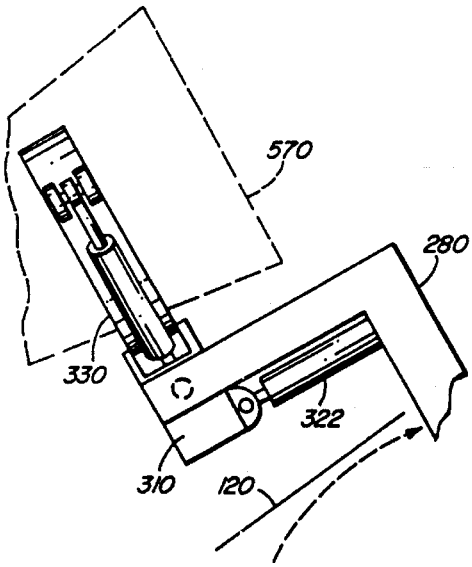
FIG. 7 is a view of the fragmentary portion of the left-hand end of the structure of FIG. 6 as it would appear at a subsequent time during the loading cycle.
Figure 8:
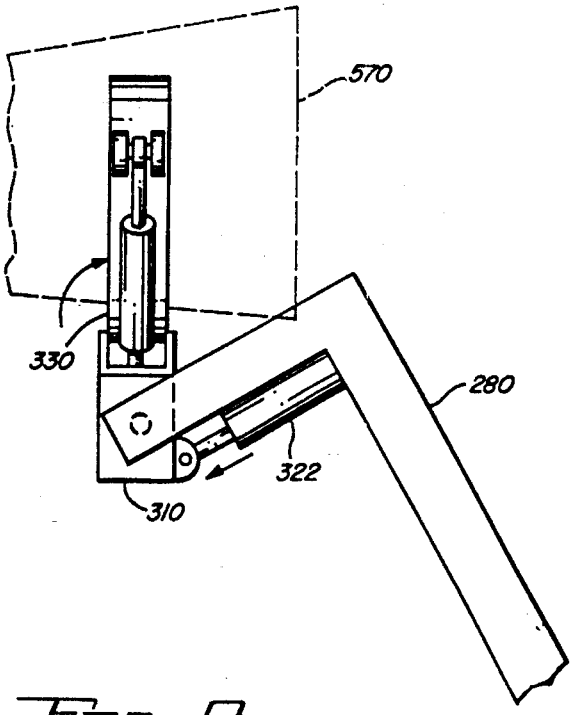
FIG. 8 is an illustration generally corresponding to the view of FIG. 7 and taken at a yet subsequent time during the loading cycle.

Prior to the terminal elevation of arm 282, approximately as container 570 is proximately aligned with panel 120, handle 432 is tilted causing rotation of shaft 425 in the direction of arrowed line $T_2$ causing cam 472 to contact and close switch 468. Resultingly, valve 535 is set for the discharge of pressurized fluid through second cylinder port into line 559. Resultingly, hydraulic cylinder assembly 322 is caused to extend in the direction indicated by arrowed line V urging tilt assembly from the rest position as illustrated in FIGS. 7 and 9 toward the tilt position as shown in FIGS. 8 and 10. At the terminal dumping position, the contents of container 570 falls to the approximate center of hopper 57. The container is tilted at an angle of approximately 135° to 150° from the original upright position. Carriage 240 resides at the street end of beam 197. Arm 282 is elevated at an angle of approximately 45°–60° from horizontal. Tilt assembly 310 has rotated approximately 90°.

The operator may observe the dumping of the container and, by visual inspection, determine that the container is empty. Visual inspection by the operator is afforded by the various features of the hopper, such as the rounded front wall 113, sloping panel 120 and the vents, or screening, 122. The placement and movement of the lifting assembly in combination with the windowed area of the cab further allows full view of the container and the clamping assembly at all times.

After the grasping, lifting and dumping cycle, as described above, is completed, the operator initiates the undumping cycle by rotating handle 432 in the direction indicated by the arrowed line $T_1$ thereby utilizing cam 472 to close switch 467 and reverse valve 535. Accordingly, fluid is directed to line 558 retracting cylinder 322 to the previously described rest position. The rest position is predetermined by the contact of actuating finger 327 with limit switch 325 residing in series with switch 467. Owing to the action of limit switch 325, handle 432 may be maintained in the tilted position, or returned to the vertical position illustrated in FIG. 17, while the arm lowers.

The operator now moves handle 432 in a direction representing an angular compromise between the directions indicated by the arrowed lines $X_1$ and $Y_2$ for concurrently closing switches 454 and 455. The function of switch 454 for urging carriage 240 in the direction of arrowed line N was previously described. The closing of switch 455 realigns valve 537 for the discharge of pressurized fluid through line 563 for the movement of hydraulic cylinder assembly 292 in a direction counter to the arrowed line O and the resultant lowering of arm 282. This movement is continued, with adjustments between the two directions as necessary, until the container is replaced to the original position. Subsequently, button 474 is depressed closing the associated switch for movement of valve 534 for discharge of fluid through the second cylinder port into line 360 from whence it is carried to hydraulic cylinder assemblies 355 and 363 for opening of the clamp assembly and release of the container. Finally, handle 432 is urged in the direction of the arrowed line $X_2$ for closing switch 457 and the resultant movement of carriage 240 to the rest position in the direction of arrowed line L, which movement is limited by switch 268. Arms 340 and 359 continue movement to the fully extended initial position. Handle 432 is released and the operator moves the vehicle to the next pick-up location.

ALTERNATE PACKER MECHANISM

As previously described in detail, platen 130, as a minimum, reciprocates through an arc of 180°. At each terminus of movement, the line of force normal to the panel 133 is parallel to the longitudinal axis of refuse storing body 50. Greater compaction, and hence, greater payload, can be had if the platen 130 reciprocates through an arc greater than 180°. The exact length of the arc, or the terminal positions of the platen, are a function of the configuration of the refuse storage body.

Figure 23:
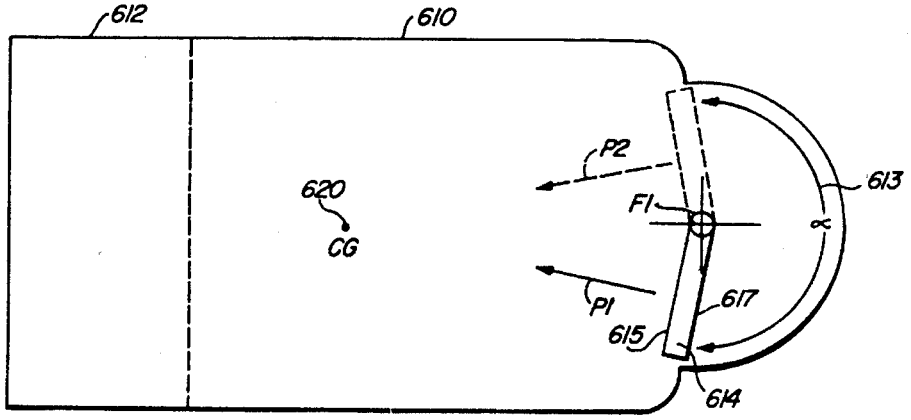
FIG. 23 is a schematic representation, in plan view, of the refuse storage body and packer mechanism of the instant invention.

Referring now to FIG. 23, there is seen a semischematic representation of a refuse containing body generally designated by the reference character 610 including tailgate assembly 612 and hopper 613. Platen 614, having opposed upright surfaces 615 and 617, is reciprocally rotatable about the axis $F_1$ as previously described in detail in connection with FIG. 16. Axis $F_1$, which is substantially vertical, intercepts the longitudinal axis of packer body 610. Platen 614 reciprocates through an arc designated by the angle alpha.

A dot, designated by the reference character 620, represents the physical center of body 610. Bearing in mind that the instant illustration is a plan view, dot 620 is located at coordinates defined by the bisectors of the length and the width of body 610. One terminus of platen 614 is illustrated in solid outline while the other is shown in broken outline. The arrowed line $P_1$ extends normally from the physical center of surface 615. Arrowed line $P_2$ is normal to surface 617 and extends from the physical center thereof. Lines $P_1$ and $P_2$, when extending from platen 614 in the respective terminal positions, will intersect at the dot 620.

Figure 24:
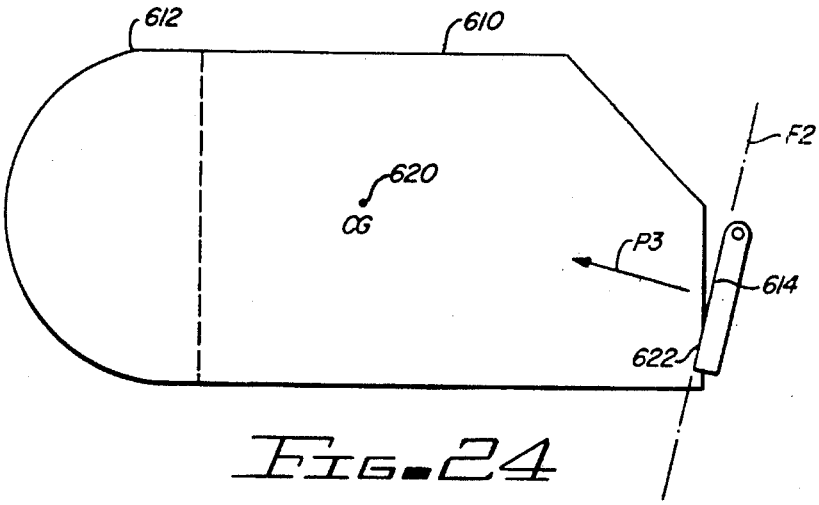
FIG. 24 is a schematic representation of the components of FIG. 23.

Complementing the arrangement described in connection with FIG. 23 is the structure, semischematically represented in the illustration of FIG. 24. Seen is body 610 having tailgate 612. The dot 620 is now further deigned as being additionally placed at a location which is one-half of the height of body 610. Platen **614*a* reciprocates about an axis designated by the broken line $F_2$. Surface 622 of platen 614*a* is generally representative of either surface 614 or surface 615 of platen 614 at which time said surface 615 or 617 is directed inwardly. Correspondingly, arrowed line $P_3$ is representative of either line $P_1$ or $P_2$. It is noted that the line of force represented by the line $P_3$ radiates from the physical center of surface 622 and is normal thereto. Further, line $P_3$ passes through dot 620**. Accordingly, axis $F_1$ is appropriately angled as illustrated by the broken line $F_2$. It is seen, therefore, that the force of the surfaces of the platen, when viewed in three dimension at the terminal positions thereof, project toward the physical center of the refuse containing body. Hence, maximum compaction of the refuse is achieved. Advantageously, therefore, a greater load may be carried in a smaller body in accordance with the instant invention.

Figure 25:
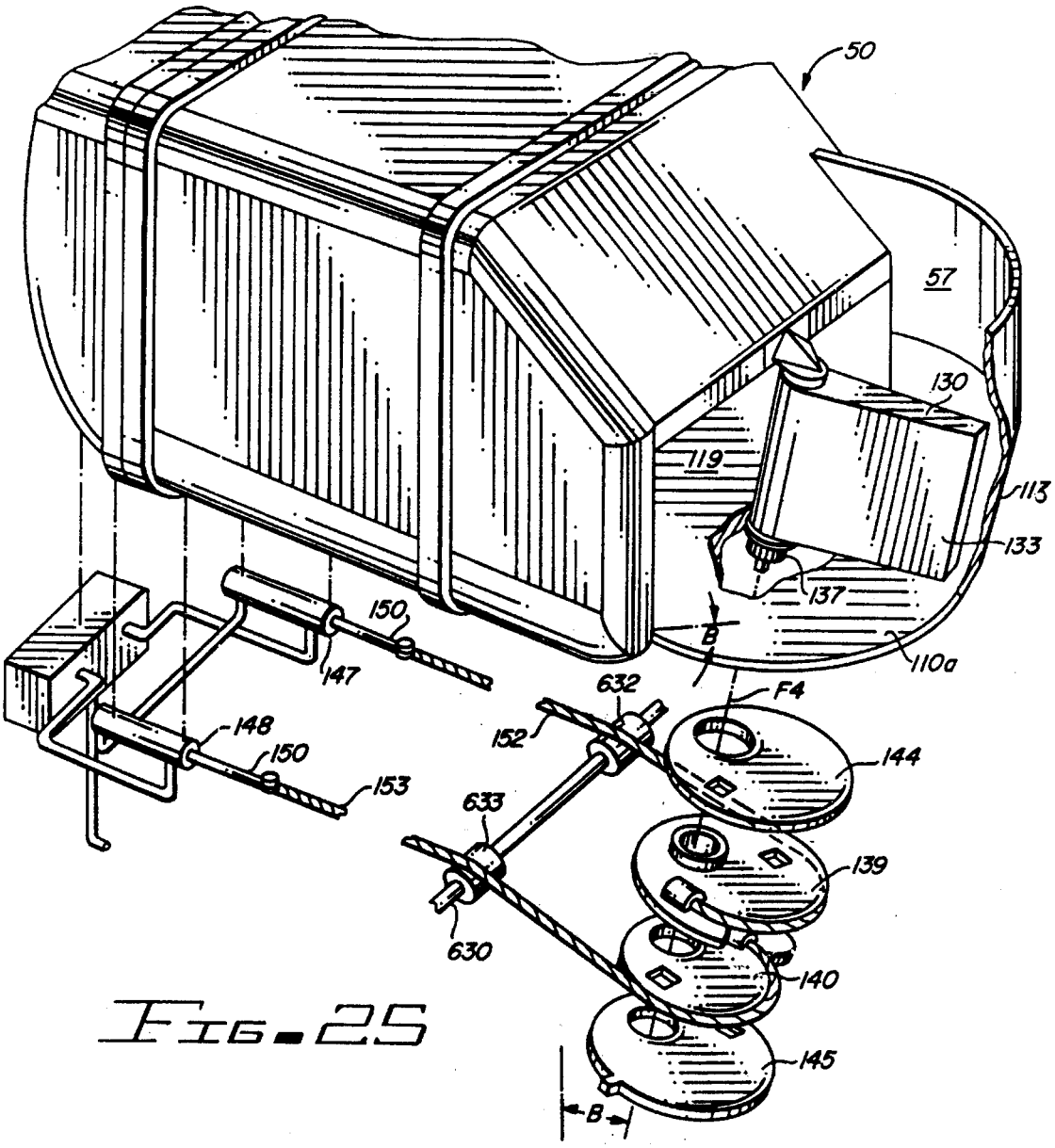
FIG. 25 is a view generally corresponding to the view of FIG. 16 and showing an alternate embodiment thereof.

Semischematically illustrated in FIG. 25 is an alternate embodiment of a packer mechanism of the instant invention especially devised to meet the parameters set forth in connection with FIGS. 23 and 24. In general similarity with the previously described embodiment, the immediate packer mechanism includes first and second hydraulic cylinder assemblies 147 and 148, respectively, which, through cables 152 and 153, impart rotation to first sheave 139 and second sheave 140, respectively. In response thereto, platen 130 functions within hopper 57. In accordance with the immediate embodiment, platen 130 rotates about axis $F_4$, which is the previously described axis F set at an angle beta to align with the previously described axes $F_1$ and $F_2$. Correspondingly, hopper 57 is modified by floor 110*a* which slopes downwardly by the angle beta to be normal to axis $F_4$. Similarly included is angled main wall 113*a* which is perpendicular to floor 110*a*.

Hydraulic cylinder assemblies 147 and 148 are mounted, as previously described, in substantial horizontal alignment with the under-surface of refuse containing body 50. Operating rods 150 move along axes which are substantially parallel to the longitudinal axis of body 50. An axle 630 is positioned intermediate the hydraulic cylinder assemblies and the sheaves. The axle 630 is journaled to the underside of body 50 in accordance with any of several conventional means readily available to those skilled in the art. Rollers 632 and 633 are carried upon axle 630. Cable 152 passes over roller 632 while cable 153 passes over roller 633. The rollers function as a transition in the change of direction between that portion of the cable aligned with hydraulic cylinder assemblies 147 and 148 and an angle favorable for sheaves 139 and 140.

Figure 26:
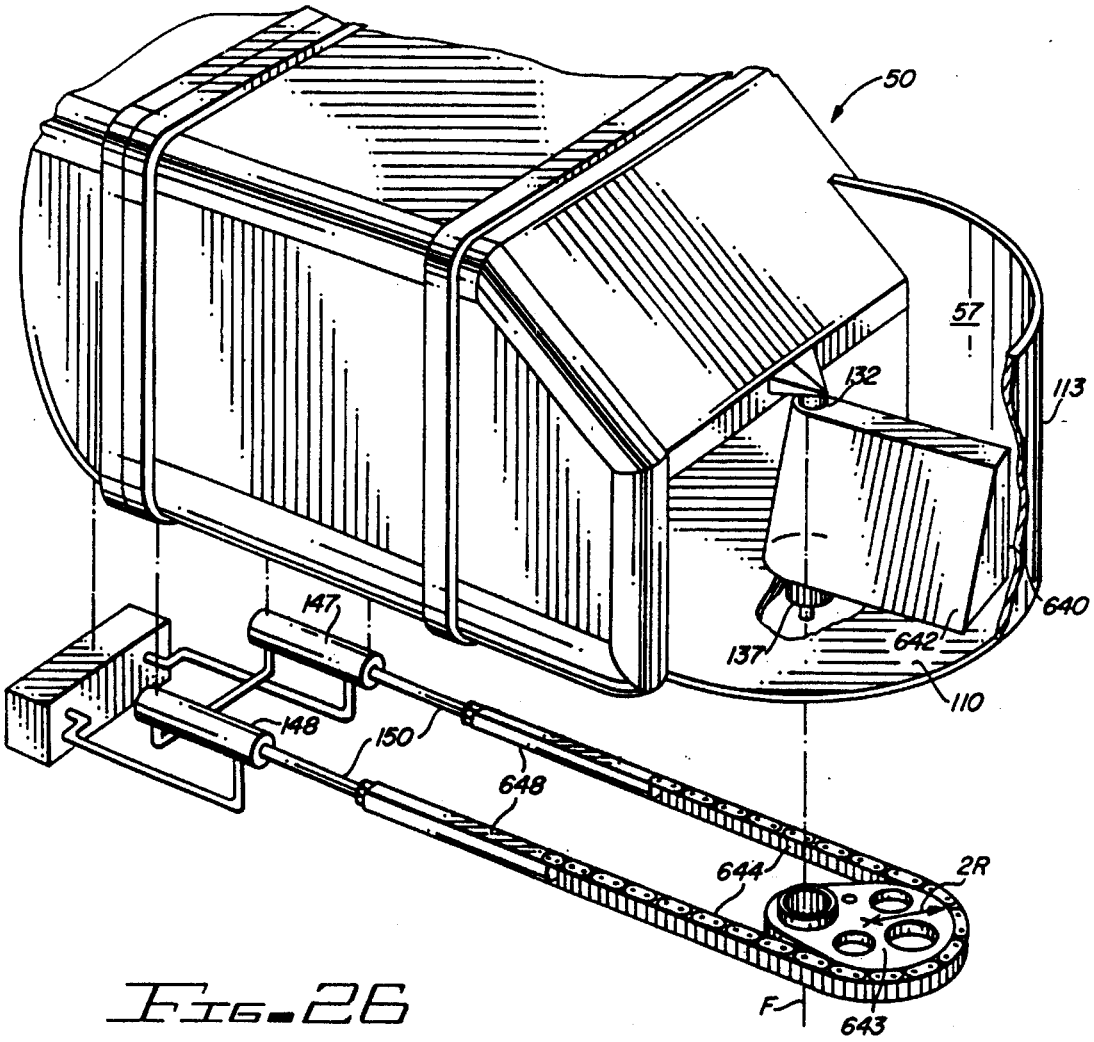
FIG. 26 is a view generally corresponding to the illustration of FIG. 16 and showing yet another alternate embodiment thereof.

FIG. 26 illustrates yet another alternate structure for directing the thrust of the packer platen as described in connection with FIGS. 23 and 24. Analogous to the embodiment previously described in detail in connection with FIG. 16, the immediate embodiment includes hopper 57 located at the forward end of body 50 and having substantially horizontal floor 110 and upright arcuate wall 113. Shaft 132, having lower spline section 137, rotates about axis F. Also included are hydraulic cylinder assemblies 147 and 148, each having operating rods 150, secured to the underside of body 50.

Carried by shaft 132 is platen 640 having a pair of opposed surface 642. Each surface 642 is inclined such that a line of force normal to the surface and extending from the physical center thereof would correspond with the arrowed line $P_3$ seen in FIG. 24.

Secured to spline portion 137 of shaft 132 is segment sprocket 643. In accordance with the immediate embodiment of the invention, in order to achieve the variable speed and force as previously described, segmental sprocket 643 includes a semicircular toothed portion having radius R extending from center Q. Spaced from center Q is spline aperture 643 which matingly receives splined section 137 of shaft 132. Drive chain 644, encircling segmental sprocket 643 and in mesh with the teeth thereof, terminates at respective ends with extension rods 648, each secured to one of the operating rods 150. Hydraulic cylinder assemblies 147 and 148 alternately function, as previously described to move platen 640 through an arc of angle alpha as previously described.

As stated previously, the inventive refuse handling vehicle depends, in part, on a plurality of series connected hydraulic valves. The use of such a series arrangement offers certain distinct advantages. First, since each valve controls the passage of hydraulic fluid to a different function, a series connected arrangement of valves permits the same fluid to be used to perform several functions Thus, the system requires less oil reducing cost and weight. Second, several functions may be performed concurrently by using a series arrangement whereas in a parallel system, the function of least resistance is performed first. Third, through the use of limit switches as described previously, a particular function is stopped permitting the oil to be directed to other functions.

It should be clear that by using the control apparatus described in connection with FIG. 17, a plurality of functions may be simultaneously addressed. However, at the operator's option, only a single function can be addressed if desired. This is important for the following reason. Typically, a refuse container of the type which is emptied by the inventive refuse collection vehicle weighs approximately three hundred pounds prior to emptying. In the rare case however, such a container may weigh as much as fifteen hundred pounds. In this case, the operator may wish to direct maximum hydraulic energy to the sole function of lifting the refuse container. If sufficient energy to lift the container is still lacking, the operator may increase engine rpm thus increasing the output of the hydraulic pump since the pump is coupled to the vehicle's transmission via the previously described pwoer take-off unit.

Having fully described and disclosed the present invention in such clear and concise terms as to enable those skilled in the art to understand and practice the same, the invention claimed is:

1. A packer assembly for use on a refuse handling vehicle equipped with a refuse receiving and storage body having a lower first surface, a hopper communicating with said body such that refuse may be transferred from said hopper into said body by said packer assembly, said hopper having a floor contiguous with said lower surface and an onboard source of pressurized fluid, comprising:

a platen mounted at one end thereof for rotation within said hopper for urging refuse within said hopper into said body;

a shaft fixedly coupled to said platen; and drive means coupled to said shaft for imparting reciprocal rotary motion to said platen alternately in clockwise and counter-clockwise cycles such that for any movement of said platen in either direction, the speed of movement of said platen will decrease throughout the cycle and the force exerted by said platen on said refuse will increase throughout said cycle, said drive means including:

a segment sprocket having a semicircular portion with a center, a non-semicircular portion and an aperture spaced from said center for receiving said shaft;

a flexible multi-jointed link member for engaging said semicircular portion; and motor means coupled to said link member for alternately rotating said segment sprocket in clockwise and counter-clockwise directions.

2. A packer assembly according to claim 1 wherein each of said cycles subtends an angle of approximately 180 degrees.

3. A packer assembly according to claim 1 wherein said motor means comprises:

first and second hydraulic cylinder assemblies coupled to a first end and a second end of said link member, respectively;

hydraulic control means coupled to said first and second hydraulic assemblies; and to said on-board source of pressurized fluid for alternately actuating said first and second hydraulic cylinder assemblies to alternately rotate said segment sprocket so as to alternately rotate said platen in clockwise and counter-clockwise directions.

4. A packer assembly according to claim 3 wherein each of said first and second hydraulic cylinder assemblies comprises:

a cylinder equipped with forward and rearward ports through which pressurized fluid may pass under the control of said hydraulic control means; and an operating rod mounted partially within said cylinder for reciprocal movement therein, each of said operating rods having a free end coupled to one of said first and second ends of said link member such that when the operating rod of said first hydraulic cylinder assembly is retracting, said segment sprocket is caused to rotate in a clockwise direction, and when the operating rod of said second hydraulic cylinder assembly is retracting, said segment sprocket is caused to rotate in a counterclockwise direction.

5. A packer assembly according to claim 3 wherein said hydraulic control means comprises a hydraulic control valve coupled between each of said forward and rearward ports and said source of pressurized fluid controlled by a limit switch.

6. A packer assembly according to claim 1 wherein each of said cycles subtends an angle of approximately 200 degrees.

7. A packer assembly according to claim 1 wherein said platen includes:

a substantially vertical panel;

a substantially lower horizontal edge coupled to said panel for generally cooperating with a floor of said hopper; and a vertical wiper assembly coupled to a vertical edge of said substantially vertical panel for cooperating generally with a vertical wall of said hopper.

* * * * *